US010522948B2

(12) United States Patent
Cho et al.

(10) Patent No.: US 10,522,948 B2
(45) Date of Patent: Dec. 31, 2019

(54) ELECTRICAL CONNECTOR AND ELECTRICAL CONNECTOR ASSEMBLY

(71) Applicant: Molex, LLC, Lisle, IL (US)

(72) Inventors: Chong Thiam Cho, Singapore (SG); Elvy Haryati, Singapore (SG); Hoon Chan Goh, Singapore (SG); Ser Kiat Toh, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/919,723

(22) Filed: Mar. 13, 2018

(65) Prior Publication Data

US 2019/0089097 A1 Mar. 21, 2019

(30) Foreign Application Priority Data

Mar. 16, 2017 (CN) ..... 2017 1 0156405

(51) Int. Cl.
*H01R 13/41* (2006.01)
*H01R 13/6471* (2011.01)
*H01R 12/71* (2011.01)

(52) U.S. Cl.
CPC ..... *H01R 13/6471* (2013.01); *H01R 12/716* (2013.01); *H01R 13/41* (2013.01)

(58) Field of Classification Search
CPC ... H01R 13/6471; H01R 13/41; H01R 12/716
See application file for complete search history.

(56) References Cited

U.S. PATENT DOCUMENTS 6,350,134 B1 * 2/2002 Fogg ..... H05K 1/0219 439/79
6,394,822 B1 * 5/2002 McNamara ..... H01R 13/6585 439/108

(Continued)

FOREIGN PATENT DOCUMENTS

CN 204947118 U 1/2016
JP H05-7829 B2 1/1993
JP 2015-513207 A 4/2015

OTHER PUBLICATIONS

Office Action received for Japanese application No. 2018-042267, dated Mar. 12, 2019, 6 pages. (3 pages of English translation and 3 pages of Official copy).

*Primary Examiner* — Truc T Nguyen
(74) *Attorney, Agent, or Firm* — Molex, LLC

(57) ABSTRACT

An electrical connector and an electrical connector assembly are disclosed. The electrical connector comprises an insulating housing and a plurality of terminal columns arranged to the insulating housing. Each terminal column comprises a plurality of ground terminals and a plurality of differential signal terminal pairs alternately arranged along a first direction. Each ground terminal has a body portion and two elastic contact portions extending from the body portion and spaced apart from each other. Each signal terminal of each differential signal terminal pair has a body portion and an elastic contact portion extending from the body portion The terminal columns are arranged along a second direction perpendicular to the first direction and are spaced apart from each other, and the differential signal terminal pair of each terminal column corresponds to the ground terminal of the adjacent terminal column in position in the second direction, an orthogonal projection of each differential signal terminal pair of each terminal column along the second direction is positioned within a range which is covered by a width of the (Continued)

corresponding ground terminal of the adjacent terminal column.

20 Claims, 30 Drawing Sheets

(56) References Cited

U.S. PATENT DOCUMENTS 6,540,559 B1 4/2003 Kemmick et al.
6,808,419 B1 10/2004 Korsunsky et al.
7,798,852 B2 9/2010 Laurx et al.
7,824,197 B1 * 11/2010 Westman ..... H01R 13/6586 439/108
2002/0137373 A1 * 9/2002 Billman ..... H01R 13/514 439/108
2007/0049118 A1 3/2007 Reeser et al.
2007/0184718 A1 * 8/2007 Akama ..... H01R 13/6585 439/607.05
2008/0182460 A1 * 7/2008 Fedder ..... H01R 12/585 439/862
2008/0207023 A1 8/2008 Tuin et al.
2010/0291803 A1 11/2010 Kirk
2012/0202363 A1 * 8/2012 McNamara ..... H01R 13/6461 439/74
2013/0273781 A1 * 10/2013 Buck ..... H01R 13/516 439/626
2014/0017957 A1 * 1/2014 Horchler ..... H01R 13/64 439/680
2014/0057493 A1 * 2/2014 De Geest ..... H01R 23/005 439/607.35
2015/0031238 A1 * 1/2015 Davis ..... H01R 12/716 439/607.05
2016/0240978 A1 * 8/2016 Yan ..... H01R 13/6471
2016/0285204 A1 * 9/2016 Morgan ..... H01R 13/6471
2017/0069986 A1 * 3/2017 Horning ..... H01R 12/7076

* cited by examiner

ELECTRICAL CONNECTOR AND ELECTRICAL CONNECTOR ASSEMBLY

RELATED APPLICATIONS

This application claims priority to Chinese Application No. 201710156405.8, filed Mar. 16, 2017, which is incorporated herein by reference in its entirety.

TECHNICAL FIELD

The present disclosure relates to an electrical connector, particularly relates to an electrical connector and an electrical connector assembly for high speed signal transmission.

BACKGROUND ART

With development of digital information science and technology in recent years, the amount of data transmission is increasing, because data transmission often needs an electrical connector to connect various ports, speed and quality of signal transmission of the electrical connector will significantly affects speed and stability of data transmission.

In existing electrical connectors, for example, Japanese patent JPH05-7829B2 discloses a mated terminal structure, in which contact portions of two mated terminals allow the contact portion of one terminal contact a fixed portion the other terminal, two contact points are formed between the two terminals so as to increase terminal contact stability. For example, U.S. Pat. No. 7,798,852 B2 discloses a mezzanine-style electrical connector which comprises a plurality of terminal columns, ground terminals and differential signal terminal pairs of each terminal column are alternately arranged, the differential signal terminal pair of each terminal column corresponds to the ground terminal of the adjacent terminal column in position, and a body portion of the ground terminal is wider so that a width of the body portion of the ground terminal is larger than a width of the differential signal terminal pair arranged side by side with the body portion of the ground terminal, so as to form an independent ground shielding with respect to each differential signal terminal pair.

In order to further enhance signal transmission speed, it needs further reduce crosstalk of signal transmission, reduce terminal impedance and enhance shielding between signal terminals. However, existing electrical connector is still insufficient.

SUMMARY

Therefore, one object of the present disclosure is to provide an electrical connector which may enhance signal transmission speed and signal integrity.

Therefore, another object of the present disclosure is to provide an electrical connector assembly.

Accordingly, in some embodiment, an electrical connector of the present disclosure comprises: an insulating housing; and a plurality of terminal columns arranged to the insulating housing. Each terminal column comprises a plurality of ground terminals and a plurality of differential signal terminal pairs arranged along a first direction, the ground terminals and the differential signal terminal pairs are alternately arranged in each terminal column, and the terminal columns are arranged along a second direction perpendicular to the first direction and are spaced apart from each other. Each ground terminal has a body portion and two elastic contact portions extending from the body portion and spaced apart from each other. Each differential signal terminal pair is composed of two signal terminals, adjacent sides of the two signal terminals of each differential signal terminal pair arranged side by side each are defined as an inner facing side of each signal terminal and a side of each signal terminal opposite to the inner facing side is defined as an outer opposite side, and each signal terminal has a body portion and an elastic contact portion extending from the body portion, and a total width of the two body portions of each differential signal terminal pair in the first direction is smaller than a width of the body portion of each ground terminal in the first direction, an orthogonal projection of the two body portions of each differential signal terminal pair on the adjacent terminal column along the second direction is positioned within a range covered by the width of the body portion of one corresponding ground terminal of the adjacent terminal column; a total width of the two elastic contact portions of each differential signal terminal pair in the first direction is smaller than a total width of the two elastic contact portions of each ground terminal in the first direction, an orthogonal projection of the two elastic contact portions of each differential signal terminal pair on the adjacent terminal column along the second direction is positioned within a range which is covered by the total width of the two elastic contact portions of one corresponding ground terminal of the adjacent terminal column.

In some embodiment, each ground terminal further has two tail portions extending from the body portion of each ground terminal and spaced apart from each other, and the two tail portions and the two elastic contact portions of each ground terminal respectively extend from two opposite sides of the body portion of each ground terminal, each signal terminal of each differential signal terminal pair further has a tail portion extending from the body portion of each signal terminal, and the tail portion and the elastic contact portion of each signal terminal respectively extend from two opposite sides of the body portion of each signal terminal, a total width of the two tail portions of each differential signal terminal pair in the first direction is smaller than a total width of the two tail portions of each ground terminal in the first direction, an orthogonal projection of the two tail portions of each differential signal terminal pair on the adjacent terminal column along the second direction is positioned within a range which is covered by the total width of the two tail portions of one corresponding ground terminal of the adjacent terminal column.

In some embodiment, a central line of the elastic contact portion of each signal terminal of each differential signal terminal pair is offset relative to a central line of the body portion of each signal terminal of each differential signal terminal pair toward the inner facing side.

In some embodiment, an orthogonal projection of the body portion of the ground terminal of each terminal column along the second direction and an orthogonal projection of the body portion of the ground terminal of the adjacent terminal column along the second direction are partially overlapped.

In some embodiment, a central line between the two signal terminals of each differential signal terminal pair is aligned with a central line of the corresponding ground terminal of the adjacent terminal column in the second direction.

In some embodiment, the tail portions of the ground terminals and the tail portions of the differential signal terminal pairs of the terminal columns bend toward the same direction.

In some embodiment, the body portion of each signal terminal of each differential signal terminal pair has a retention segment which is close to the tail portion of each signal terminal and two sides of which are formed with a plurality of retention protrusions interfering with the insulating housing and a necked-down segment which is adjacent to the retention segment and is reduced in width relative to the retention segment.

In some embodiment, the body portion of each signal terminal is at least recessed inwardly from the outer opposite side of each signal terminal to form the necked-down segment.

In some embodiment, the body portion of each signal terminal of each differential signal terminal pair is recessed inwardly from the outer opposite side of each signal terminal to form the necked-down segment, and an interval between the elastic contact portions of the two signal terminals and an interval between the body portions of the two signal terminals are substantively maintained the same at the inner facing side.

In some embodiment, the body portion of each ground terminal has a retention segment which is close to the tail portions of each ground terminal and two sides of which are formed with a plurality of retention protrusions interfering with the insulating housing and a necked-down segment which is adjacent to the retention segment of each ground terminal and is reduced in width relative to the retention segment of each ground terminal.

In some embodiment, the necked-down segment of the ground terminal is formed by recessing inwardly two sides of the body portion of the ground terminal toward each other, the necked-down segment of each signal terminal is formed by recessing inwardly two sides of the body portion of each signal terminal toward each other.

In some embodiment, the insulating housing has a bottom wall, the bottom wall has a first side and a second side which are parallel to the first direction and are positioned at two opposite ends, the insulating housing further has a plurality of protruding bars which are parallel to each other, are spaced apart from each other, protrude from the bottom wall, are positioned between the first side and the second side, extend along the first direction and each exhibit as an elongated shape, the bottom wall and the protruding bars together define a plurality of insertion slots, and the protruding bars and the insertion slots are alternately arranged along the second direction, the insulating housing further has a plurality of ground terminal receiving grooves respectively receiving the ground terminals and a plurality of signal terminal receiving grooves respectively receiving the signal terminals, the ground terminal receiving grooves and the signal terminal receiving grooves are provided to wall surfaces of the protruding bars adjacent to the insertion slots.

In some embodiment, the insulating housing further has a plurality of recessed accommodating portions respectively corresponding to the elastic contact portions in position, and every two recessed accommodating portions corresponding to each differential signal terminal pair are communicated with each other at two portions which each correspondingly approach a tail end of the elastic contact portion of each signal terminal.

In some embodiment, the body portion of each signal terminal of each differential signal terminal pair has a stopping block close to the elastic contact portion of each signal terminal and protruding from the outer opposite side of each signal terminal, the insulating housing is formed with a narrow groove portion in form of slit at a region of the insulating housing corresponding to each signal terminal receiving groove to latch with the stopping block, which makes the body portion of each signal terminal not move in the second direction.

In some embodiment, the insulating housing further has two positioning grooves which are adjacent to the first side and are positioned at two opposite ends in the first direction, a side wall which protrudes from the bottom wall, is adjacent to the second side, extends along the first direction and exhibits as an elongated shape, and two positioning keys which protrude from the bottom wall and respectively extend from two ends of the side wall in form of L shape, the two positioning keys are respectively latched with the two positioning grooves of another electrical connector which has the same structure.

Accordingly, in some embodiment, an electrical connector assembly of the present disclosure comprises two electrical connectors which have the same structure and are mated with each other, each electrical connector comprises: an insulating housing; and a plurality of terminal columns arranged to the insulating housing. Each terminal column comprises a plurality of ground terminals and a plurality of differential signal terminal pairs arranged along a first direction, the ground terminals and the differential signal terminal pairs are alternately arranged in each terminal column, and the terminal columns are arranged along a second direction perpendicular to the first direction and are spaced apart from each other. Each ground terminal has a body portion and two elastic contact portions extending from the body portion and spaced apart from each other. Each differential signal terminal pair is composed of two signal terminals, adjacent sides of the two signal terminals of each differential signal terminal pair arranged side by side each are defined as an inner facing side of each signal terminal and a side of each signal terminal opposite to the inner facing side is defined as an outer opposite side, and each signal terminal has a body portion and an elastic contact portion extending from the body portion, and a total width of the two body portions of each differential signal terminal pair in the first direction is smaller than a width of the body portion of each ground terminal in the first direction, an orthogonal projection of the two body portions of each differential signal terminal pair on the adjacent terminal column along the second direction is positioned within a range covered by the width of the body portion of one corresponding ground terminal of the adjacent terminal column. A total width of the two elastic contact portions of each differential signal terminal pair in the first direction is smaller than a total width of the two elastic contact portions of each ground terminal in the first direction, an orthogonal projection of the two elastic contact portions of each differential signal terminal pair on the adjacent terminal column along the second direction is positioned within a range which is covered by the total width of the two elastic contact portions of one corresponding ground terminal of the adjacent terminal column.

In some embodiment, when the two electrical connectors are mated with each other, mated ground terminals make every two elastic contact portions of the mated ground terminals mated with each other and every two mated elastic contact portions form two contact points, mated signal terminals make the two elastic contact portions of the mated signal terminals mated with each other and form two contact points.

In some embodiment, each ground terminal of each electrical connector further has two tail portions extending from the body portion of each ground terminal and spaced apart from each other, and the two tail portions and the two elastic contact portions of each ground terminal respectively extend from two opposite sides of the body portion of each ground terminal, each signal terminal of each differential signal terminal pair further has a tail portion extending from the body portion of each signal terminal, and the tail portion and the elastic contact portion of each signal terminal respectively extend from two opposite sides of the body portion of each signal terminal, a total width of the two tail portions of each differential signal terminal pair in the first direction is smaller than a total width of the two tail portions of each ground terminal in the first direction, an orthogonal projection of the two tail portions of each differential signal terminal pair on the adjacent terminal column along the second direction is positioned within a range which is covered by the total width of the two tail portions of one corresponding ground terminal of the adjacent terminal column.

In some embodiment, a central line of the elastic contact portion of each signal terminal of each differential signal terminal pair is offset relative to a central line of the body portion of each signal terminal of each differential signal terminal pair toward the inner facing side.

In some embodiment, an orthogonal projection of the body portion of the ground terminal of each terminal column along the second direction and an orthogonal projection of the body portion of the ground terminal of the adjacent terminal column along the second direction are partially overlapped.

In some embodiment, a central line between the two signal terminals of each differential signal terminal pair is aligned with a central line of the corresponding ground terminal of the adjacent terminal column in the second direction.

In some embodiment, the tail portions of the ground terminals and the tail portions of the differential signal terminal pairs of the terminal columns in each electrical connector bend toward the same direction.

In some embodiment, the body portion of each signal terminal of each differential signal terminal pair of each electrical connector has a retention segment which is close to the tail portion of each signal terminal and two sides of which are formed with a plurality of retention protrusions interfering with the insulating housing and a necked-down segment which is adjacent to the retention segment and is reduced in width relative to the retention segment.

In some embodiment, the body portion of each signal terminal is at least recessed inwardly from the outer opposite side of each signal terminal to form the necked-down segment.

In some embodiment, the body portion of each signal terminal of each differential signal terminal pair is recessed inwardly from the outer opposite side of each signal terminal to form the necked-down segment, and an interval between the elastic contact portions of the two signal terminals and an interval between the body portions of the two signal terminals are substantively maintained the same at the inner facing side.

In some embodiment, the body portion of each ground terminal of each electrical connector has a retention segment which is close to the tail portions of each ground terminal and two sides of which are formed with a plurality of retention protrusions interfering with the insulating housing and a necked-down segment which is adjacent to the retention segment of each ground terminal and is reduced in width relative to the retention segment of each ground terminal.

In some embodiment, the necked-down segment of the ground terminal is formed by recessing inwardly two sides of the body portion of the ground terminal toward each other, the necked-down segment of each signal terminal is formed by recessing inwardly two sides of the body portion of each signal terminal toward each other.

In some embodiment, the insulating housing of each electrical connector has a bottom wall, the bottom wall has a first side and a second side which are parallel to the first direction and are positioned at two opposite ends, the insulating housing further has a plurality of protruding bars which are parallel to each other, are spaced apart from each other, protrude from the bottom wall, are positioned between the first side and the second side, extend along the first direction and each exhibit as an elongated shape, the bottom wall and the protruding bars together define a plurality of insertion slots, and the protruding bars and the insertion slots are alternately arranged along the second direction, the insulating housing further has a plurality of ground terminal receiving grooves respectively receiving the ground terminals and a plurality of signal terminal receiving grooves respectively receiving the signal terminals, the ground terminal receiving grooves and the signal terminal receiving grooves are provided to wall surfaces of the protruding bars adjacent to the insertion slots.

In some embodiment, the insulating housing of each electrical connector further has a plurality of recessed accommodating portions respectively corresponding to the elastic contact portions in position, and every two recessed accommodating portions corresponding to each differential signal terminal pair are communicated with each other at two portions which each correspondingly approach a tail end of the elastic contact portion of each signal terminal.

In some embodiment, the body portion of each signal terminal of each differential signal terminal pair has a stopping block close to the elastic contact portion of each signal terminal and protruding from the outer opposite side of each signal terminal, the insulating housing is formed with a narrow groove portion in form of slit at a region of the insulating housing corresponding to each signal terminal receiving groove to latch with the stopping block, which makes the body portion of each signal terminal not move in the second direction.

In some embodiment, the insulating housing of each electrical connector further has two positioning grooves which are adjacent to the first side and are positioned at two opposite ends in the first direction, a side wall which protrudes from the bottom wall, is adjacent to the second side, extends along the first direction and exhibits as an elongated shape, and two positioning keys which protrude from the bottom wall and respectively extend from two ends of the side wall in form of L shape, the two positioning keys are used to respectively latch with the two positioning grooves of the other electrical connector.

In some embodiment, the two the electrical connector are mezzanine electrical connectors.

Accordingly, in some embodiment, an electrical connector of the present disclosure comprises: an insulating housing; and a plurality of terminal columns arranged to the insulating housing. Each terminal column comprises a plurality of ground terminals and a plurality of differential signal terminal pairs arranged along a first direction and the ground terminals and the differential signal terminal pairs are alternately arranged in each terminal column. Each ground terminal has two tail portions spaced apart from each other, each signal terminal of each differential signal terminal pair has a tail portion, and a total width of the two tail portions of each differential signal terminal pair in the first direction is smaller than a total width of the two tail portions of each ground terminal in the first direction. The terminal columns are arranged along a second direction perpendicular to the first direction and are spaced apart from each other, an arrangement pattern of the terminals of the terminal columns is: the terminals of one terminal column of every two adjacent terminal columns are alternately arranged as one ground terminal, one differential signal terminal pair and one ground terminal so as to make two tail portions of one ground terminal, two tail portions of two signal terminals, two tail portions of one ground terminal alternately arranged along the first direction, the terminals of the other terminal column of every two adjacent terminal columns are alternately arranged as one differential signal terminal pair, one ground terminal and one differential signal terminal pair so as to make two tail portions of two signal terminals, two tail portions of one ground terminal, two tail portions of two signal terminals alternately arranged along the first direction, and the differential signal terminal pair of one terminal column of every two adjacent terminal columns corresponds to the ground terminal of the other terminal column of every two adjacent terminal columns in position in the second direction, an orthogonal projection of the two tail portions of each differential signal terminal pair of one terminal column of every two adjacent terminal columns along the second direction is positioned within a range which is covered by the total width of the two tail portions of one corresponding ground terminal of the other terminal column of every two adjacent terminal columns.

The present disclosure has the following effects: by the structural design of the ground terminals and the signal terminals and the arrangement pattern of the ground terminals and the differential signal terminal pairs in the present disclosure, more complete and comprehensive shielding effect can be formed with respect to each differential signal terminal pair to reduce crosstalk and increase signal transmission speed. Also the present disclosure can reduce impedance of the terminal and enhance coupling between the two signal terminals of each differential signal terminal pair to enhance signal integrity.

BRIEF DESCRIPTION OF THE DRAWINGS

Other features and effects of the present disclosure will be apparent through embodiments in combination with accompanying figures in which.

DETAILED DESCRIPTION OF THE PREFERRED EMBODIMENTS

Figure 1:
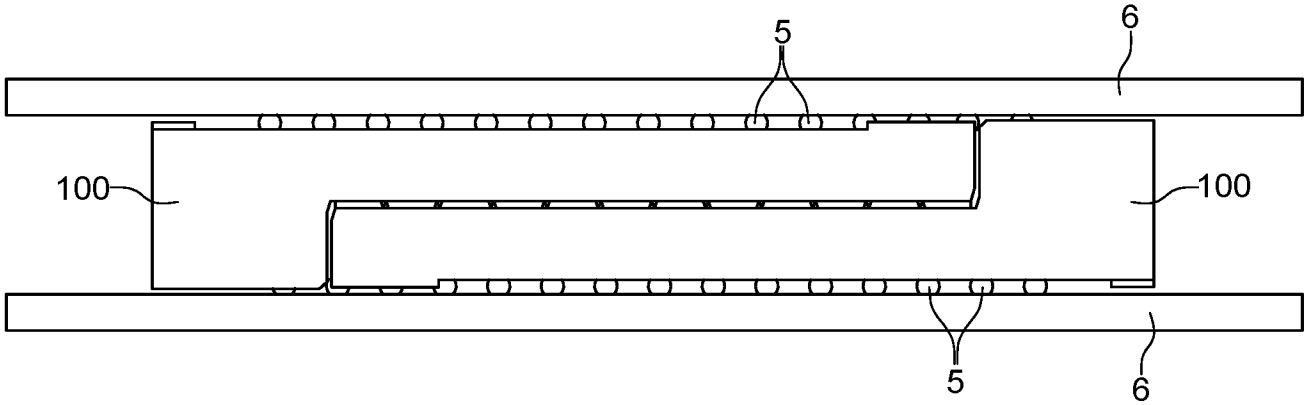
FIG. 1 is a side view of a first embodiment of an electrical connector assembly of the present disclosure.

Before the present disclosure is described in detail, it should be noted that similar element is indicated by a like reference numeral in the following content.

Figure 2:
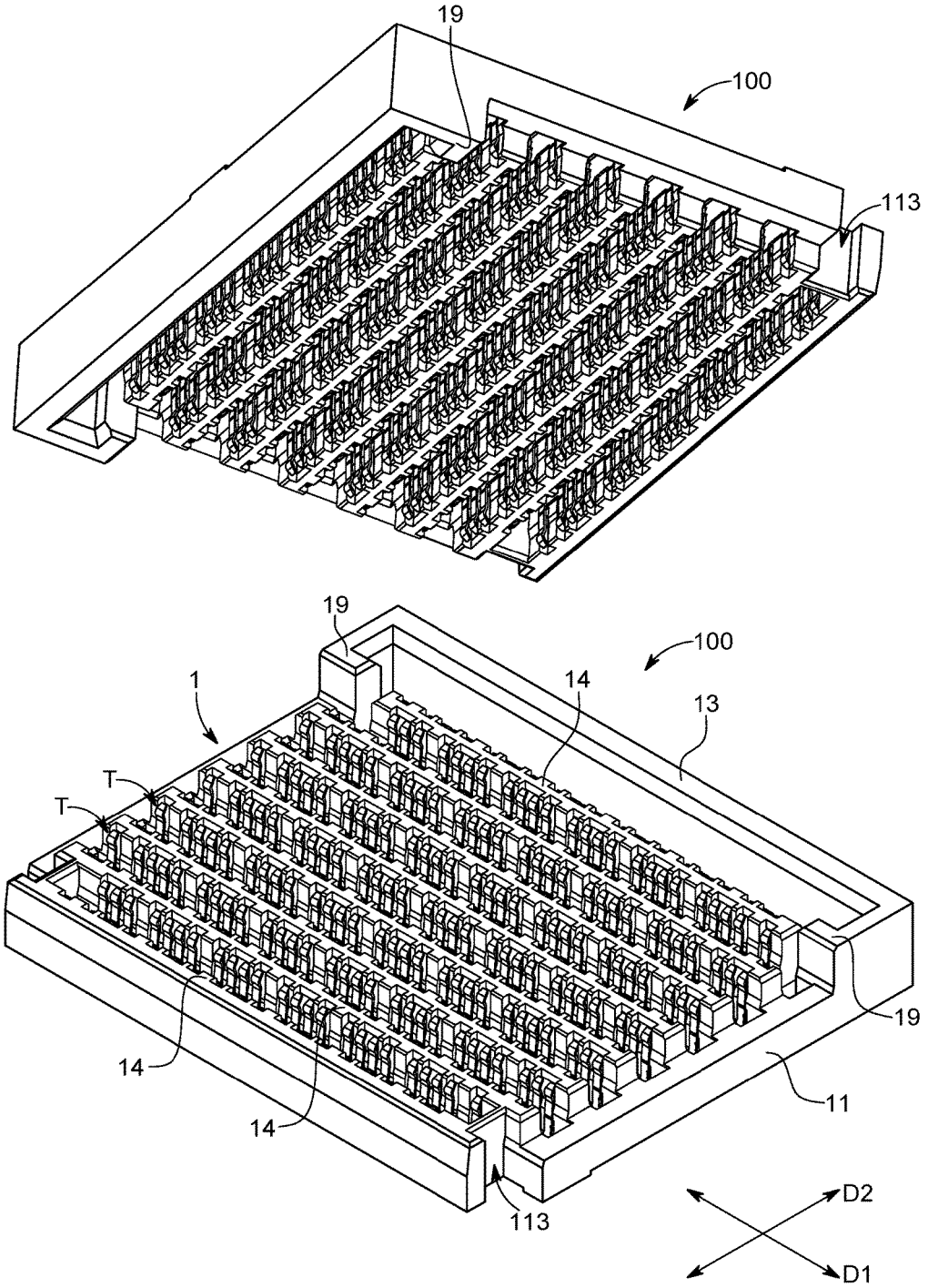
FIG. 2 is a perspective exploded view of the first embodiment.
Figure 3:
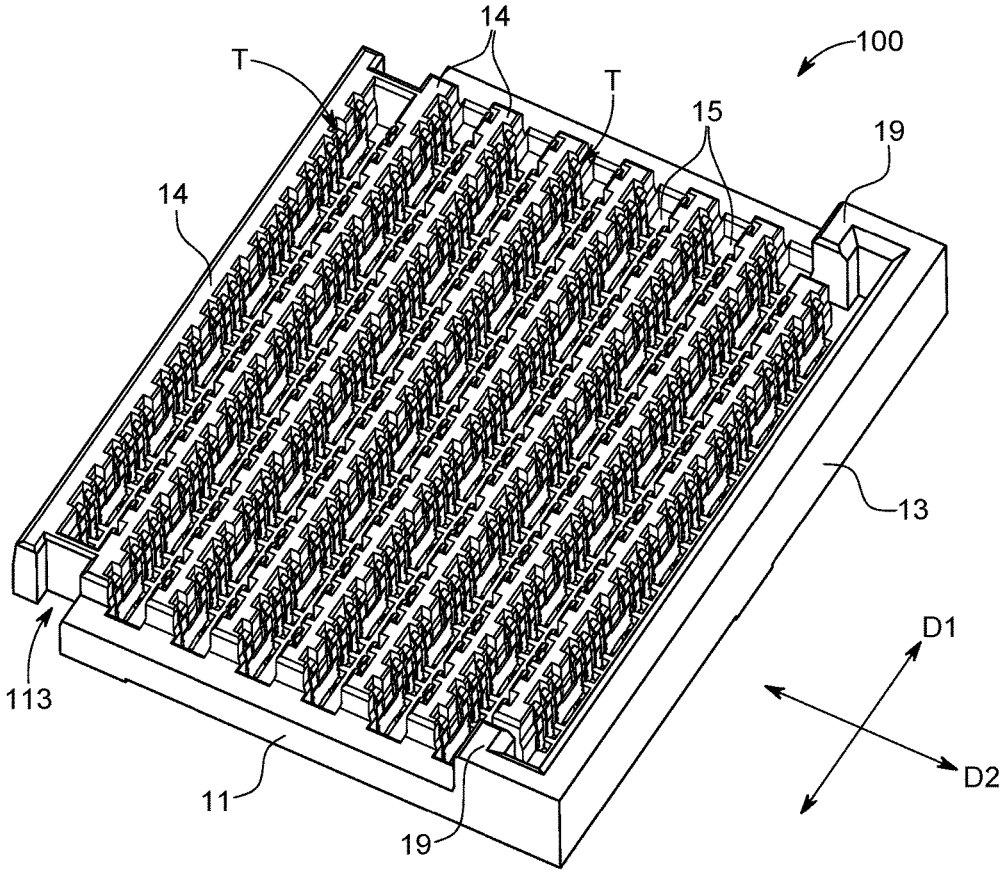
FIG. 3 is a perspective view of one of two electrical connectors of the first embodiment.

Referring to FIG. 1 to FIG. 3, a first embodiment of an electrical connector assembly of the present disclosure comprises two electrical connectors 100 which are the same in structure and mated with each other, each electrical connector 100 comprises an insulating housing 1 and a plurality of terminal columns T arranged to the insulating housing 1.

Figure 4:
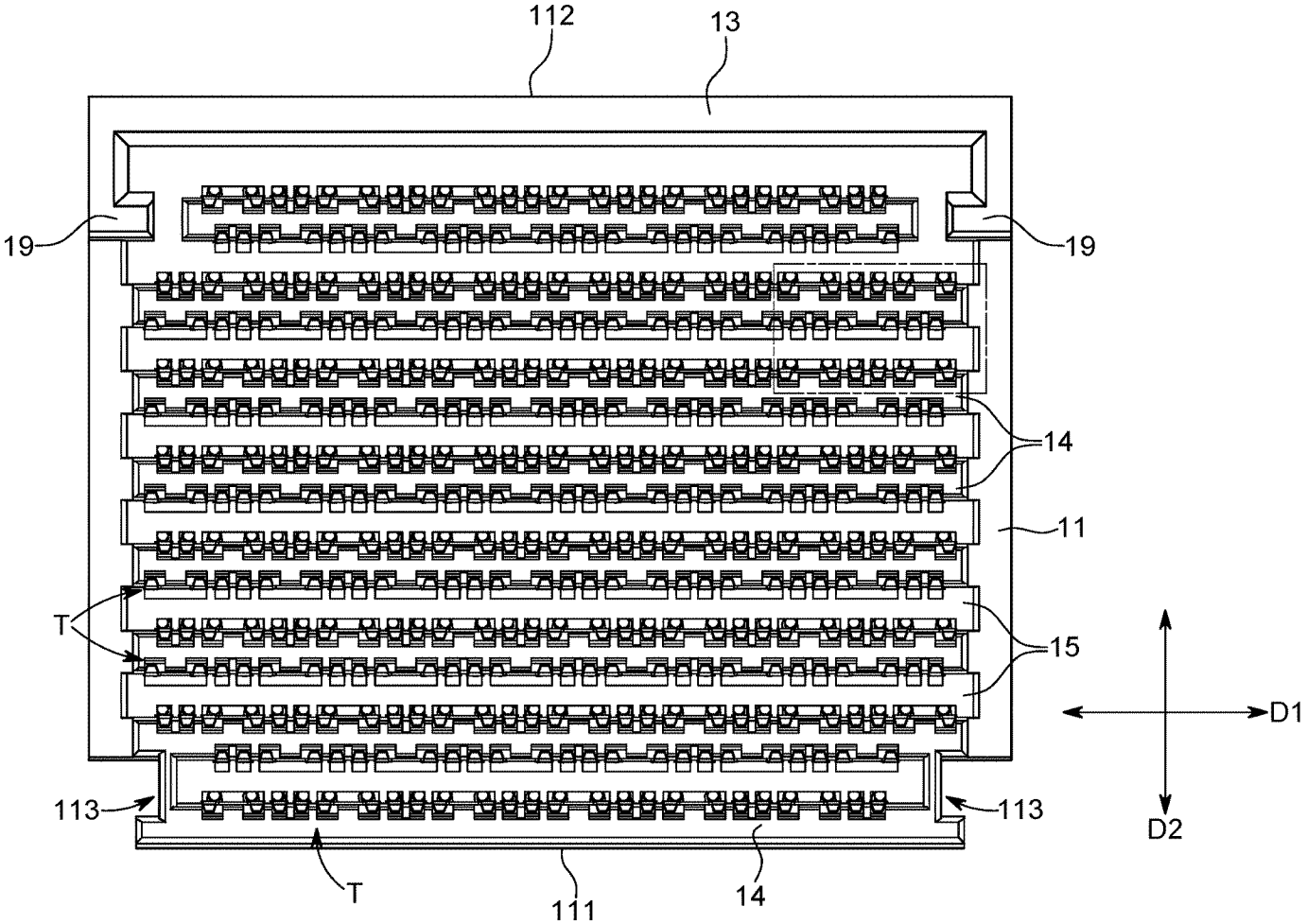
FIG. 4 is a top view of the electrical connector of the first embodiment.
Figure 5:
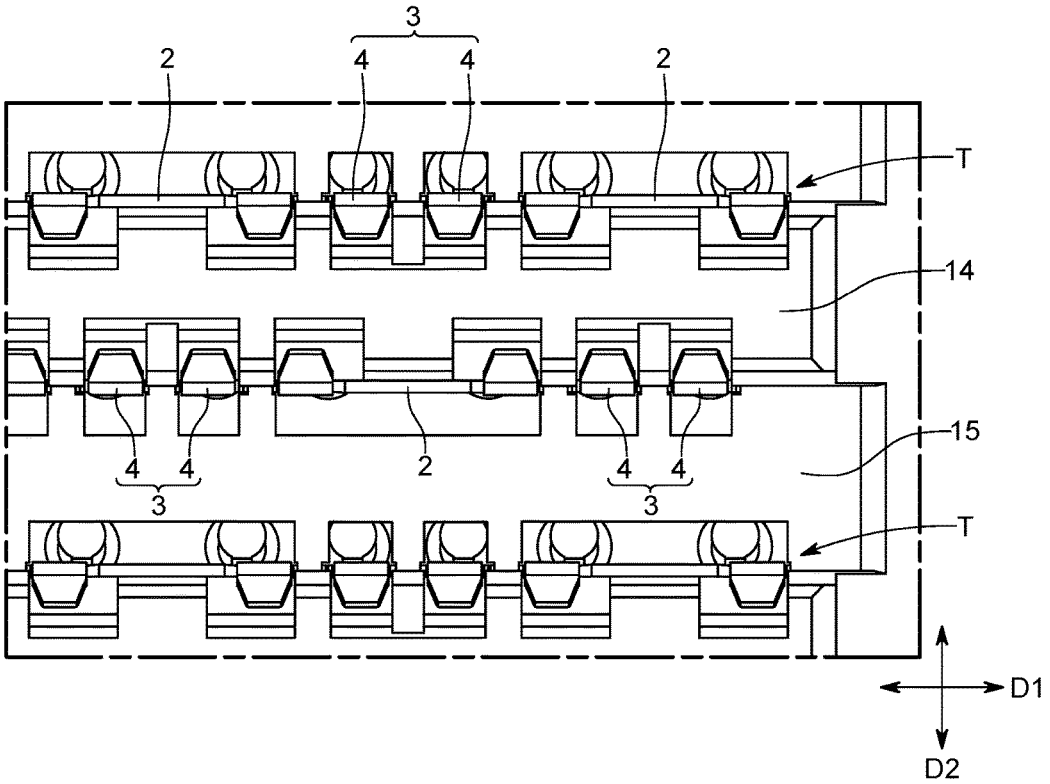
FIG. 5 is a partial enlarged view of FIG. 4.
Figure 6:
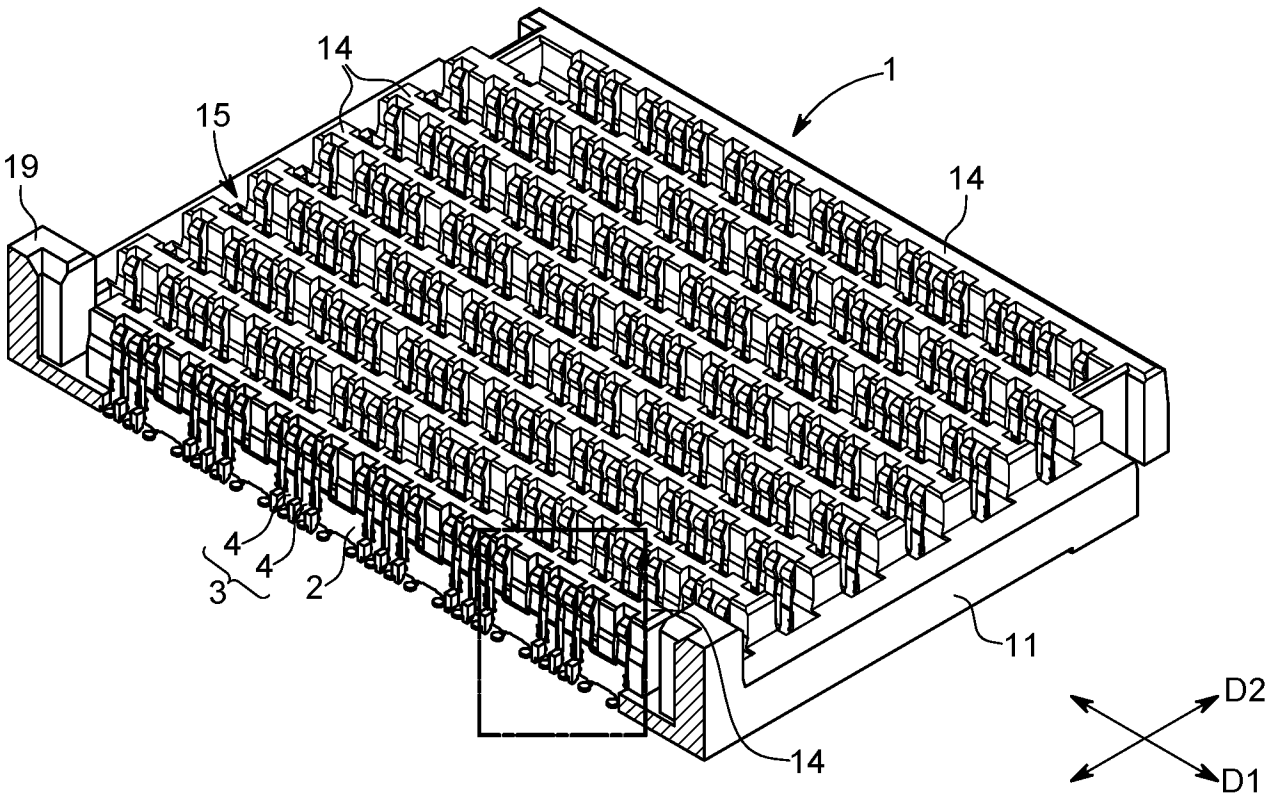
FIG. 6 is a perspective sectional view of the electrical connector of the first embodiment.
Figure 7:
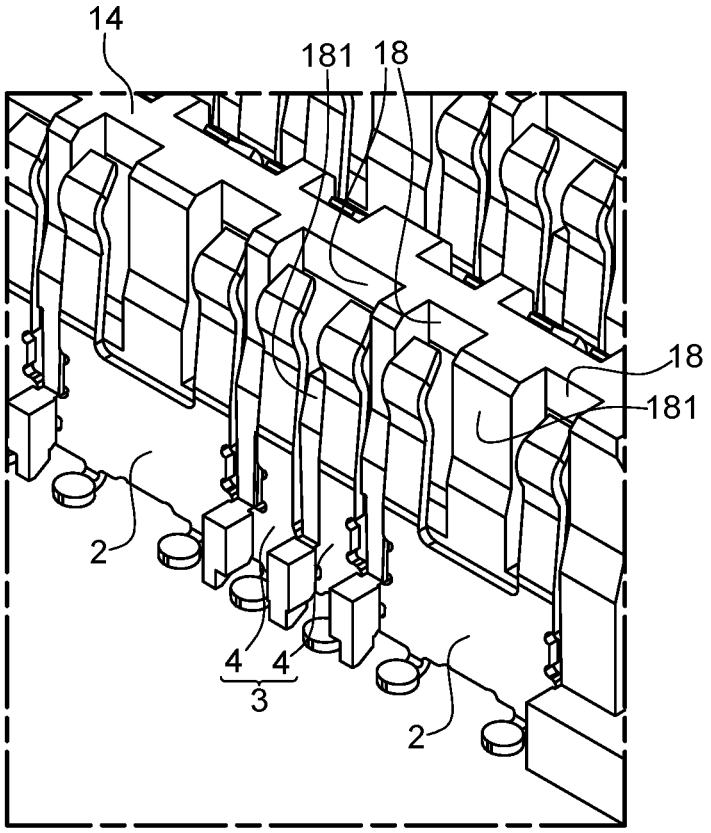
FIG. 7 is a partial enlarged view of FIG. 6.
Figure 8:
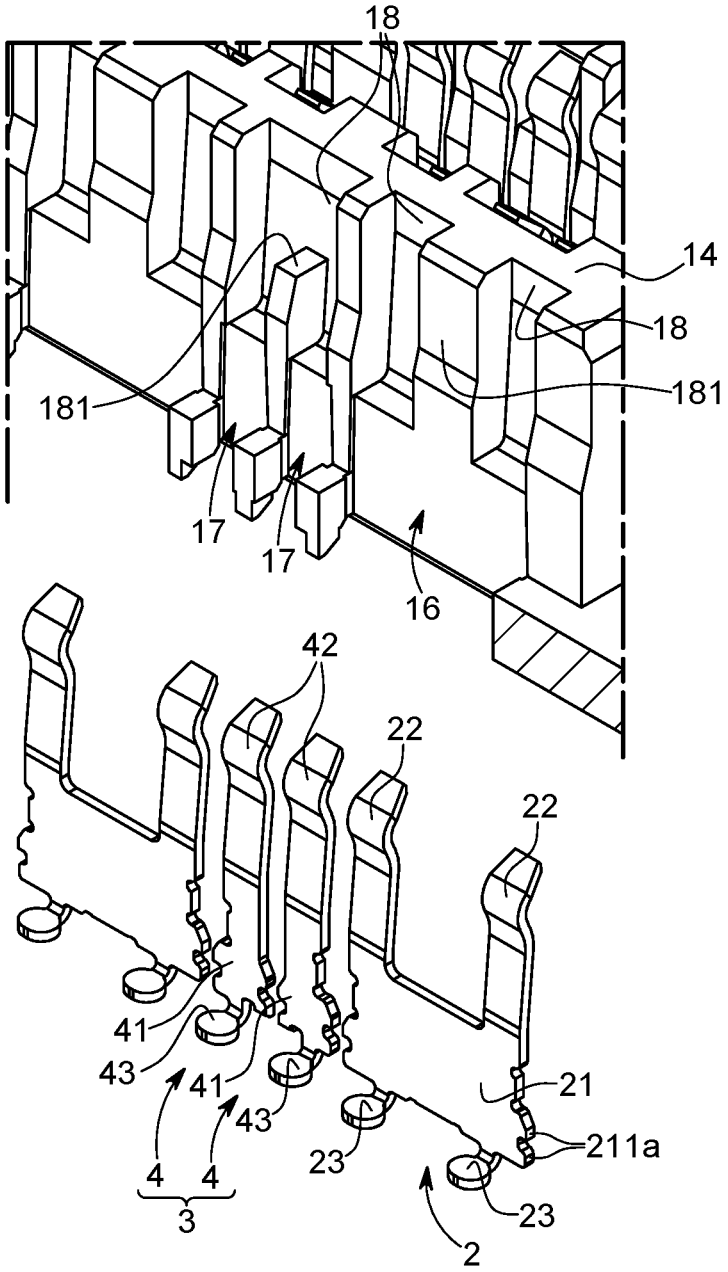
FIG. 8 is a perspective exploded view similar to FIG. 7.
Figure 9:
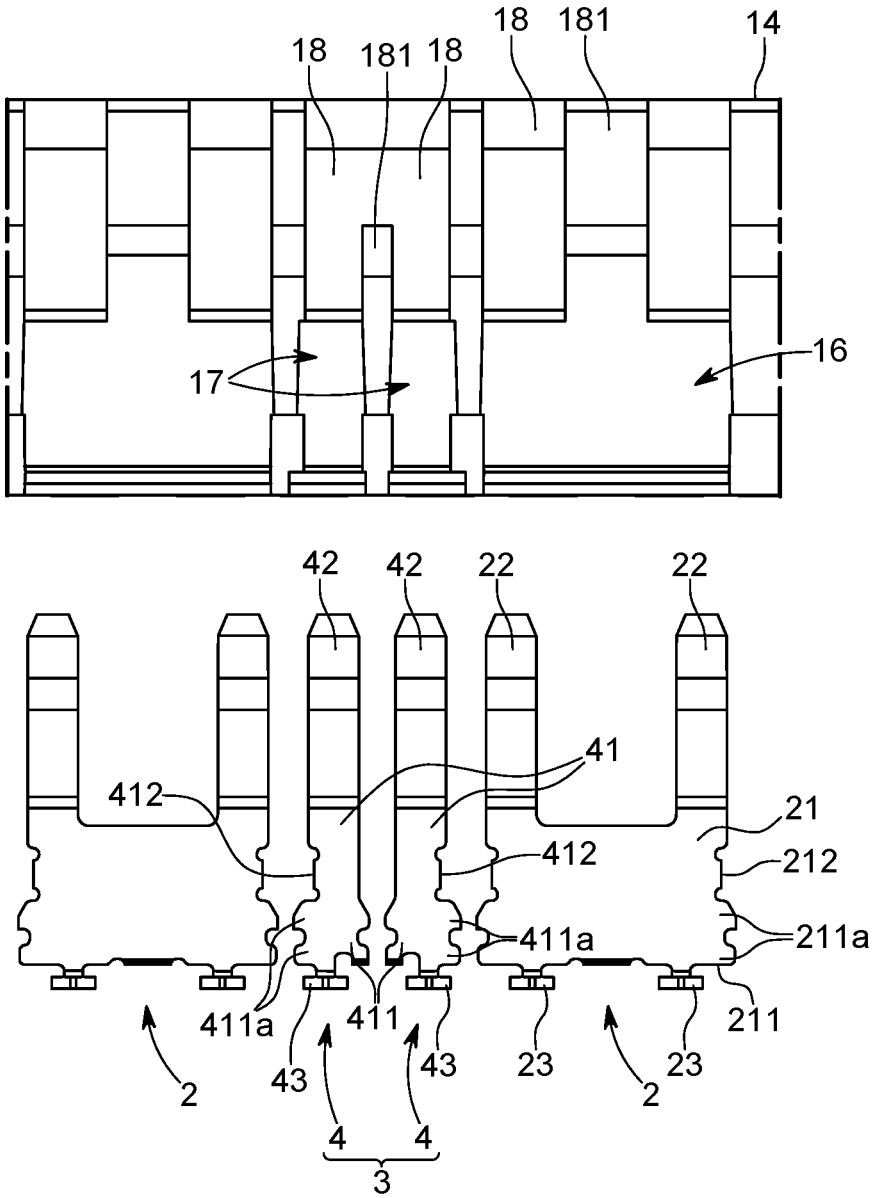
FIG. 9 is a front view of FIG. 8.

Referring to FIG. 3 to FIG. 5, the insulating housing 1 of each electrical connector 100 has a bottom wall 11, the bottom wall 11 has a first side 111 and a second side 112 which are parallel to a first direction D1 and are positioned at two opposite ends. The insulating housing 1 further has a plurality of protruding bars 14 which are parallel to each other, are spaced apart from each other, protrude from the bottom wall 11, are positioned between the first side 111 and the second side 112, extend along the first direction D1 and each exhibit as an elongated shape, the bottom wall 11 and the protruding bars 14 together define a plurality of insertion slots 15, and the protruding bars 14 and the insertion slots 15 are alternately arranged along a second direction D2 perpendicular to the first direction D1.

Each terminal column T comprises a plurality of ground terminals 2 and a plurality of differential signal terminal pairs 3 arranged along the first direction D1, each differential signal terminal pair 3 is composed of two signal terminals 4, and the ground terminals 2 and the differential signal terminal pairs 3 are alternately arranged in each terminal column T. Wall surfaces of the protruding bar 14 respectively adjacent to the insertion slots 15 each are provided with one terminal column T, so as to make the terminal columns T arranged along the second direction D2 and spaced apart from each other.

Referring to FIG. 6 to FIG. 9, each ground terminal 2 has a body portion 21, two elastic contact portions 22 extending from the body portion 21 and spaced apart from each other and two tail portions 23 extending from the body portion 21 and spaced apart from each other, and the two tail portions 23 and the two elastic contact portions 22 respectively extend from two opposite sides of the body portion 21. Taking the orientation of these figures as a reference, the elastic contact portion 22 extends upwardly from the body portion 21, and the tail portion 23 extend downwardly from the body portion 21. The body portion 21 has a retention segment 211 which is close to the tail portions 23 and two sides of which are formed with a plurality of retention protrusions 211*a* interfering with the insulating housing 1 and a necked-down segment 212 which is adjacent to the retention segment 211 and is reduced in width relative to the retention segment 211. That is, the necked-down segment 212 is positioned above the retention segment 211, and the retention segment 211 is positioned between the necked-down segment 212 and the tail portions 23. In the embodiment, the necked-down segment 212 of the ground terminal 2 is formed by recessing inwardly two sides of the body portion 21 toward each other. Each signal terminal 4 has a body portion 41, an elastic contact portion 42 extending from the body portion 41 and a tail portion 43 extending from the body portion 41, and the tail portion 43 and the elastic contact portion 42 respectively extend from two opposite sides of the body portion 41. The body portion 41 of each signal terminal 4 has a retention segment 411 which is close to the tail portion 43 and two sides of which are formed with a plurality of retention protrusions 411*a* interfering with the insulating housing 1 and a necked-down segment 412 which is adjacent to the retention segment 411 and is reduced in width relative to the retention segment 411. Similarly, the elastic contact portion 42 of the signal terminal 4 extends upwardly from the body portion 41, and the tail portion 43 extends downwardly from the body portion 41. The necked-down segment 412 is positioned above the retention segment 411, and the retention segment 411 is positioned between the necked-down segment 412 and the tail portion 43. Adjacent sides of the two signal terminals 4 of each differential signal terminal pair 3 arranged side by side each are defined as an inner facing side of each signal terminal 4 and a side of each signal terminal 4 opposite to the inner facing side is defined as an outer opposite side, in the embodiment, the body portion 41 of each signal terminal 4 of each differential signal terminal pair 3 is recessed inwardly from the outer opposite side of each signal terminal 4 to form the necked-down segment 412, and an interval between the elastic contact portions 42 of the two signal terminals 4 and an interval between the body portions 41 of the two signal terminals 4 are substantively maintained the same at the inner facing side. Because the body portion 21 of the ground terminal 2 are formed with the retention protrusions 211*a* at the two sides of the retention segment 211, a width of the retention segment 211 is relative large, thereby increasing impedance, but the impedance is reduced by reducing the necked-down segment 212 in width so as to balance the increased impedance due to the retention segment 211. Similarly, because the body portion 41 of the signal terminal 4 are formed with the retention protrusions 411*a* at the two sides of the retention segment 411, a width of the retention segment 411 is relative large, thereby increasing impedance, but the impedance is reduced by reducing the necked-down segment 412 in width, so as to balance increased impedance due to the retention segment 411.

The insulating housing 1 further has a plurality of ground terminal receiving grooves 16 respectively receiving the ground terminals 2, a plurality of signal terminal receiving grooves 17 respectively receiving the signal terminals 4 and a plurality of recessed accommodating portions 18 respectively corresponding to the elastic contact portions 22, 42 in position, the ground terminal receiving grooves 16, the signal terminal receiving grooves 17 and the recessed accommodating portions 18 are provided to the wall surfaces of the protruding bars 14 adjacent to the insertion slots 15, and every two recessed accommodating portions 18 corresponding to each differential signal terminal pair 3 are communicated with each other at two portions which each correspondingly approach a tail end of the elastic contact portion 42 of each signal terminal 4. That is to say, a height of a spacing rib 181 between the two recessed accommodating portions 18 which correspond to each differential signal terminal pair 3 is lower than a height of the elastic contact portion 42 of each signal terminal 4, so that two parts of the two elastic contact portions 42 of each differential signal terminal pair 3 respectively approaching the tail ends of the two elastic contact portions 42 are not blocked by the spacing rib 181, which can increase coupling between the two signal terminals of each differential signal terminal pair 3, so as to enhance signal integrity. When the ground terminal 2 is assembled to the ground terminal receiving groove 16, the ground terminal 2 is inserted into the ground terminal receiving groove 16 from down to up from the bottom wall 11 side, the retention protrusions 211*a* of the ground terminal 2 interfere with groove walls defining the ground terminal receiving groove 16 and the ground terminal 2 is fixed, and a side surface of the body portion 21 of the ground terminal 2 abuts against a surface of the groove walls which faces the insertion slot 15. Similarly, when the signal terminal 4 is assembled to the signal terminal receiving groove 17, the signal terminal 4 is inserted into signal terminal receiving groove 17 from down to up from the bottom wall 11 side, the retention protrusions 411*a* of the signal terminal 4 interfere with groove walls defining the signal terminal receiving groove 17 and the signal terminal 4 is fixed, and a side surface of the body portion 41 of the signal terminal 4 abuts against a surface of the groove wall which faces the insertion slot 15.

Figure 10:
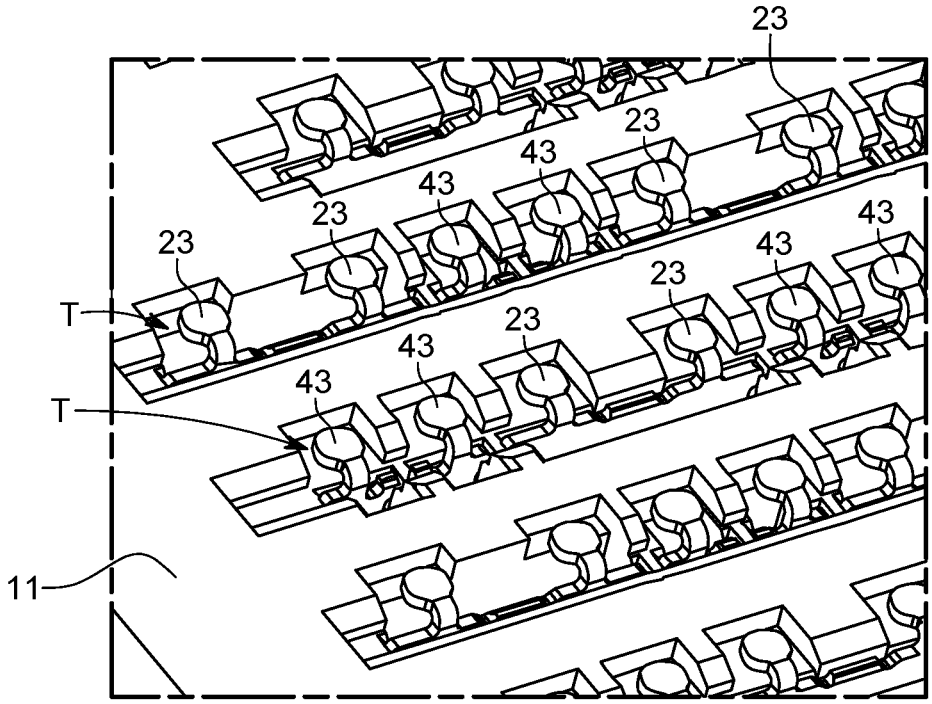
FIG. 10 is a partial perspective view of the electrical connector of the first embodiment viewed from the bottom.
Figure 17:
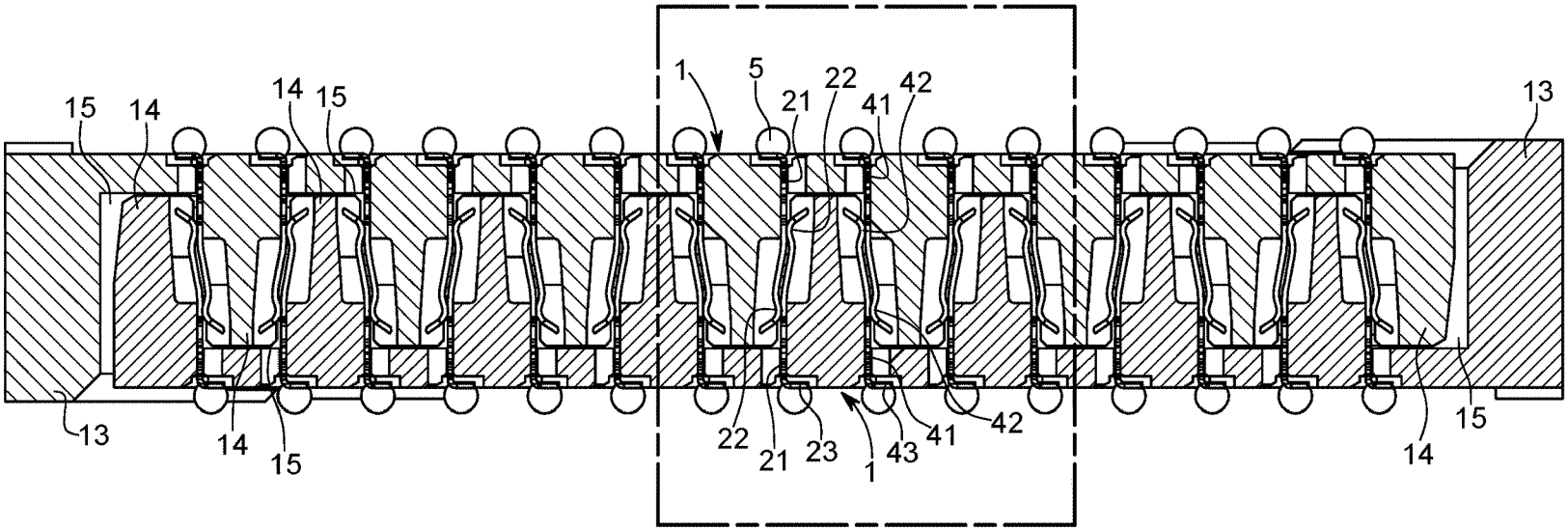
FIG. 17 is a cross sectional view viewed from another angle and illustrating that the two electrical connectors of the first embodiment are in the assembled state.
Figure 18:
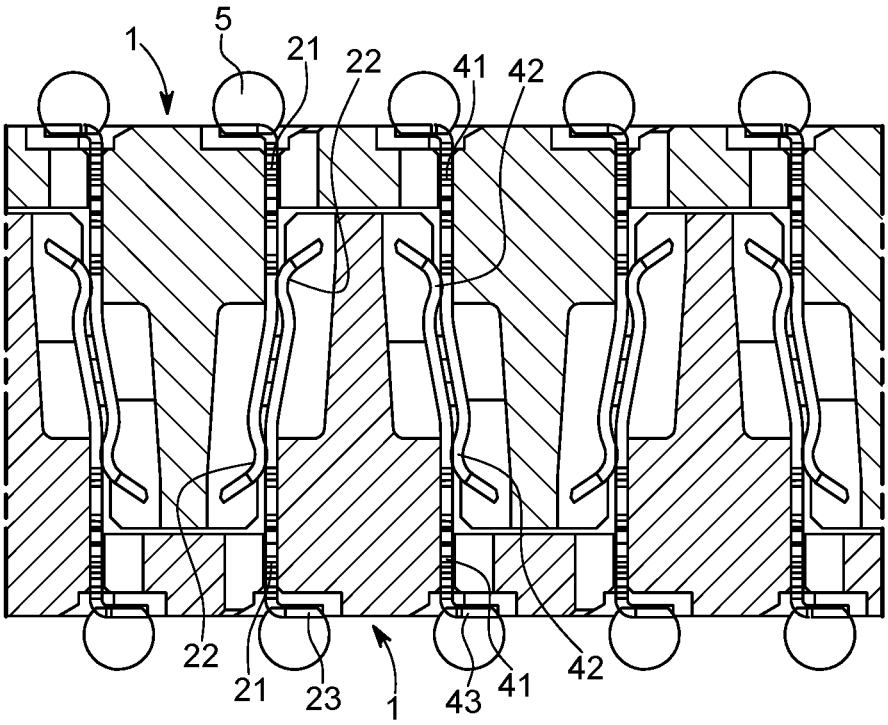
FIG. 18 is a partial enlarged view of FIG. 17.

In the embodiment, the tail portion 23 of the ground terminal 2 bends at a right angle from a bottom end of body portion 21 and extends and is exposed outside the bottom wall 11, the tail portion 23 is soldered to a circuit board 6 (see FIG. 1) via a solder ball 5 (see FIG. 1, FIG. 17 and FIG. 18). Similarly, the tail portion 43 of the signal terminal 4 bends at a right angle from a bottom end of body portion 41 and extends and is exposed outside the bottom wall 11 so as to be soldered by the solder ball 5. Referring to FIG. 10 and FIG. 17, in the embodiment, the tail portions 23 of the ground terminals 2 and the tail portions 43 of the differential signal terminal pairs 3 bend toward the same direction. In a varied embodiment, these tail portions may have other configuration, such as needle-eye type press-fit leg, through hole type soldering leg and surface soldering leg.

Figure 11:
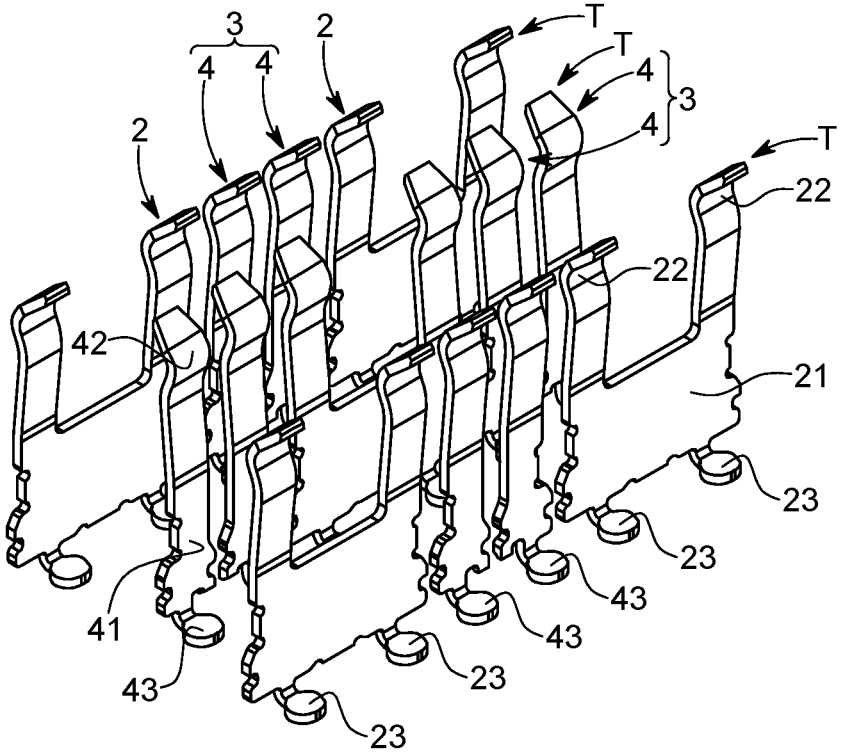
FIG. 11 is a partial perspective view of terminal columns of the first embodiment, in which an insulating housing is not shown.
Figure 12:
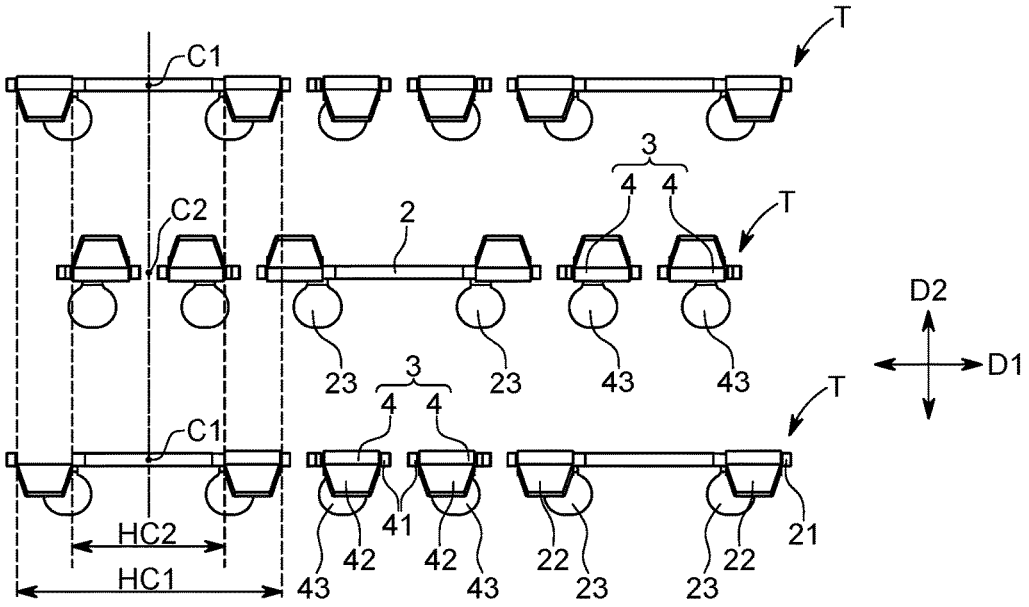
FIG. 12 is a top view of FIG. 11.
Figure 13:
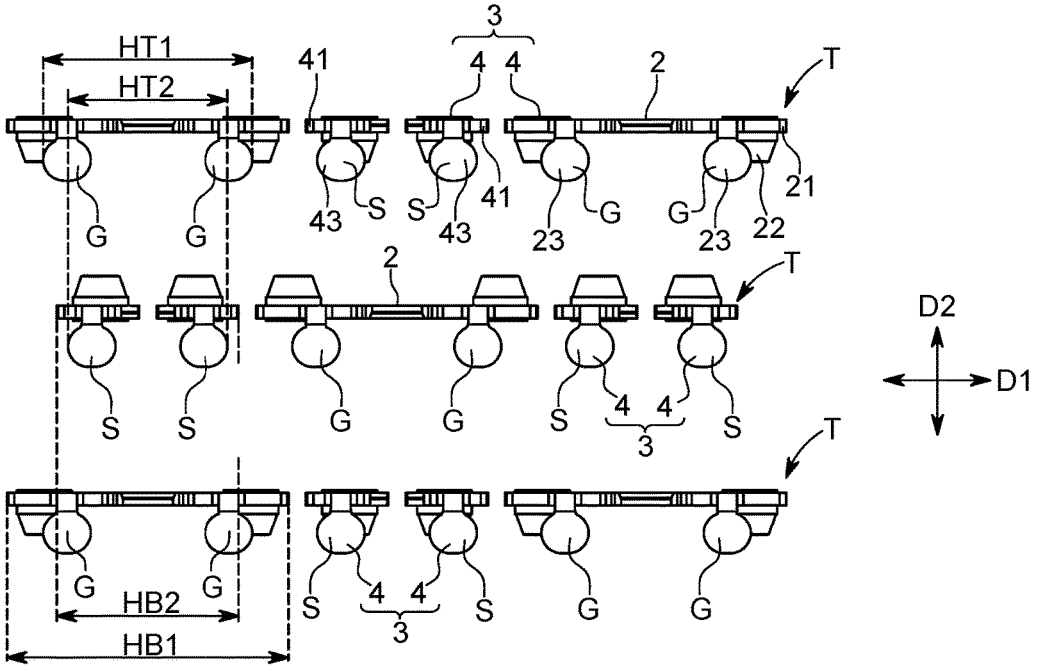
FIG. 13 is a bottom view of FIG. 11.

Referring to FIG. 11 to FIG. 13, in the embodiment, the differential signal terminal pair 3 of one terminal column T of every two adjacent terminal columns T corresponds to the ground terminal 2 of the other terminal column T of every two adjacent terminal columns T in position in the second direction D2. An arrangement pattern of the terminals of the terminal columns is: the terminals of one terminal column T of every two adjacent terminal columns T are arranged that one ground terminal 2, one differential signal terminal pair 3, one ground terminal 2 . . . are alternately arranged, so as to make two elastic contact portions 22 of one ground terminal 2, two elastic contact portions 42 of two signal terminals 4, two elastic contact portions 22 of one ground terminal 2 . . . alternately arranged along the first direction D1, and make two tail portions 23 of one ground terminal 2, two tail portions 43 of two signal terminals 4, two tail portions 23 of one ground terminal 2 . . . alternately arranged along the first direction D1, so that an arrangement pattern of ground signals G and differential signals S is G, G, S, S, G, G, . . . , the terminals of the other terminal column T of every two adjacent terminal columns T are arranged that one differential signal terminal pair 3, one ground terminal 2, one differential signal terminal pair 3 . . . are alternately arranged, so as to make two elastic contact portions 42 of two signal terminals 4, two elastic contact portions 22 of one ground terminal 2, two elastic contact portions 42 of two signal terminals 4 . . . alternately arranged along the first direction D1, and make two tail portions 43 of two signal terminals 4, two tail portions 23 of one ground terminal 2, two tail portions 43 of two signal terminals 4 . . . alternately arranged along the first direction D1, so that an arrangement pattern of ground signals G and differential signal S is S, S, G, G, S, S, . . . .

In the embodiment, a total width HB2 of the two body portions 41 of each differential signal terminal pair 3 in the first direction D1 is smaller than a width HB1 of the body portion 21 of each ground terminal 2 in the first direction D1, the total width HB2 of the two body portions 41 is a distance which is between the two outer opposite sides of the two body portions 41 and includes the interval between the two body portions 41, an orthogonal projection of the two body portions 41 of each differential signal terminal pair 3 on the adjacent terminal column T along the second direction D2 is positioned within a range covered by the width HB1 of the body portion 21 of one corresponding ground terminal 2 of the adjacent terminal column T. A total width HC2 of the two elastic contact portions 42 of each differential signal terminal pair 3 in the first direction D1 is smaller than a total width HC1 of the two elastic contact portions 22 of each ground terminal 2 in the first direction D1. Similarly, the total width HC2 of the two elastic contact portions 42 is a distance which is between the two outer opposite sides of the two elastic contact portions 42 and includes the interval between the two elastic contact portions 42, the total width HC1 of the two elastic contact portions 22 is a distance which is between the two outer opposite sides of the two elastic contact portions 22 and includes the interval between the two elastic contact portions 22, an orthogonal projection of the two elastic contact portions 42 of each differential signal terminal pair 3 on the adjacent terminal column T along the second direction D2 is positioned within a range which is covered by the total width HC1 of the two elastic contact portions 22 of one corresponding ground terminal 2 of the adjacent terminal column T. And a total width HT2 of the two tail portions 43 of each differential signal terminal pair 3 in the first direction D1 is smaller than a total width HT1 of the two tail portions 23 of each ground terminal 2 in the first direction D1, similarly, the total width HT2 of the two tail portions 43 is a distance which is between the two outer opposite sides of the two tail portions 43 and includes the interval between the two tail portions 43, the total width HT1 of the two tail portions 23 is a distance which is between the two outer opposite sides of the two tail portions 23 and includes the interval between the two tail portions 23, an orthogonal projection of the two tail portions 43 of each differential signal terminal pair 3 on the adjacent terminal column T along the second direction D2 is positioned within a range which is covered by the total width HT1 of the two tail portions 23 of one corresponding ground terminal 2 of the adjacent terminal column T. So an orthogonal projection of a width of each differential signal terminal pair 3 along the second direction D2 is positioned within a range which is covered by a width of one corresponding ground terminal 2. In an embodiment, a central line C2 between the two signal terminals of each differential signal terminal pair 3 is aligned with a central line C1 of the corresponding ground terminal 2 in the adjacent terminal column T in the second direction D2. In an embodiment, an orthogonal projection of the body portion 21 of the ground terminal 2 of each terminal column T along the second direction D2 and an orthogonal projection of the body portion 21 of the ground terminal 2 of the adjacent terminal column T along the second direction D2 are partially overlapped. By that the width HB1 of the body portion 21 of the ground terminal 2 is larger than the total width HB2 of the two body portions 41 of each differential signal terminal pair 3, it can enlarge a distance between every two differential signal terminal pairs 3 positioned in the same terminal column T which the ground terminal 2 belongs to, and can enlarge a distance between the differential signal terminal pairs 3 of the adjacent terminal columns T along a diagonal direction, which can inhibit crosstalk between the differential signal terminal pairs 3 of the adjacent terminal columns T along the diagonal direction. By that the total width HC1 of the two elastic contact portions 22, the width HB1 of the body portion 21 and the total width HT1 of the two tail portions 23 in the ground terminal 2 are respectively larger than the total width HB2 of the two body portions 41, the total width HC2 of the two elastic contact portions 42 and the total width HT2 of the two tail portions 43 in the differential signal terminal pair 3, that is to say, an overall width of the ground terminal 2 is larger than an overall width of the differential signal terminal pair 3, it can enhance virtual shield between the differential signal terminal pairs 3 in the same terminal column T and virtual shield between differential signal terminal pairs 3 in the adjacent terminal columns T, so as to reduce crosstalk. Moreover, most of the differential signal terminal pairs 3 each are surrounded by the ground terminals 2 in the same terminal column and the ground terminals 2 in the adjacent terminal columns, it also can enhance virtual shield to reduce crosstalk. Also, the arrangement pattern of the tail portions 23, 43 of the ground terminals 2 and the signal terminals 4 in the embodiment corresponds to an arrangement pattern of soldering pads (not shown) on the circuit board 6 (see FIG. 1), that is one terminal column of every two adjacent terminal column is G, G, S, S, G, G, . . . , the other terminal column of every two adjacent terminal column is S, S, G, G, S, S, . . . , with such an arrangement pattern, shielding between the soldering pads of the circuit board 6 which the tail portions 23, 43 are respectively connected can be enhanced to reduce crosstalk. Therefore, by the structural design of the above ground terminals 2 and the signal terminals 4 and the arrangement pattern of the ground terminals 2 and the differential signal terminal pairs 3, more complete and comprehensive shielding effect can be formed with respect to each differential signal terminal pair 3 to reduce crosstalk and increase signal transmission speed.

Figure 14:
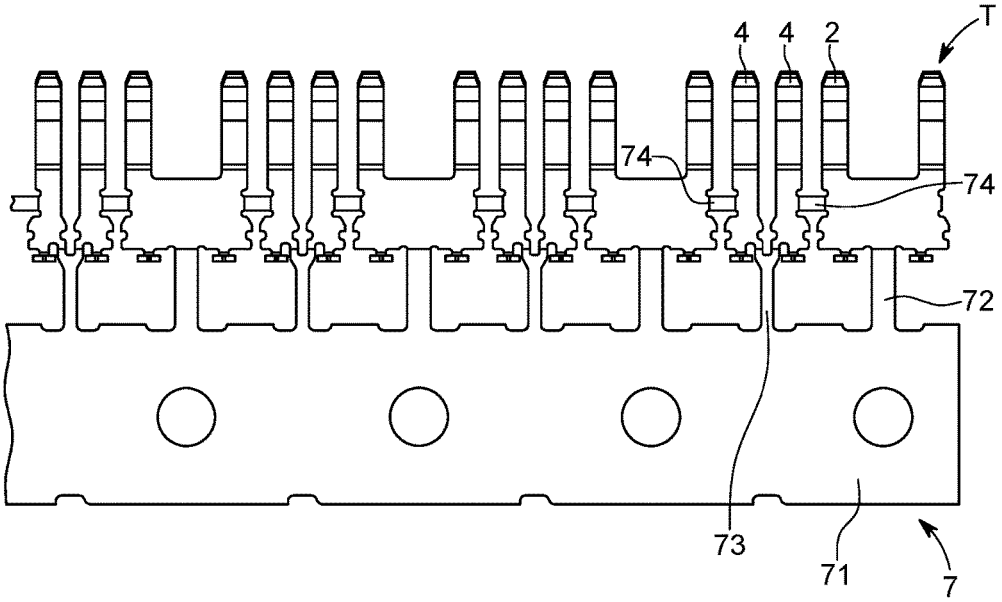
FIG. 14 is a non-complete plan view illustrating the terminal columns of the first embodiment connected to a strip after the terminal columns are formed and before the terminal columns are assembled to the insulating housing.

Referring to FIG. 14, in the embodiment, each terminal column T is preformed onto a strip 7, a first connecting segment 72 is connected between each ground terminal 2 and a strip body 71, a second connecting segment 73 is connected between each differential signal terminal pair 3 and the strip body 71, the two sides of the body portion 21 of each ground terminal 2 each are connected to the body portion 41 of one adjacent signal terminal 4 via a third connecting segment 74. When each terminal column T is ready to assemble to the insulating housing 1, connected portions between the connecting segments 72, 73, 74 and the ground terminal 2 and the signal terminal 4*s* are cut off, so as to respectively insert the ground terminals 2 and the signal terminals 4 into the corresponding ground terminal receiving grooves 16 and the corresponding signal terminal receiving grooves 17 (see FIG. 8), so that an assembling process of the terminal column T and the insulating housing 1 is more convenient.

Figure 15:
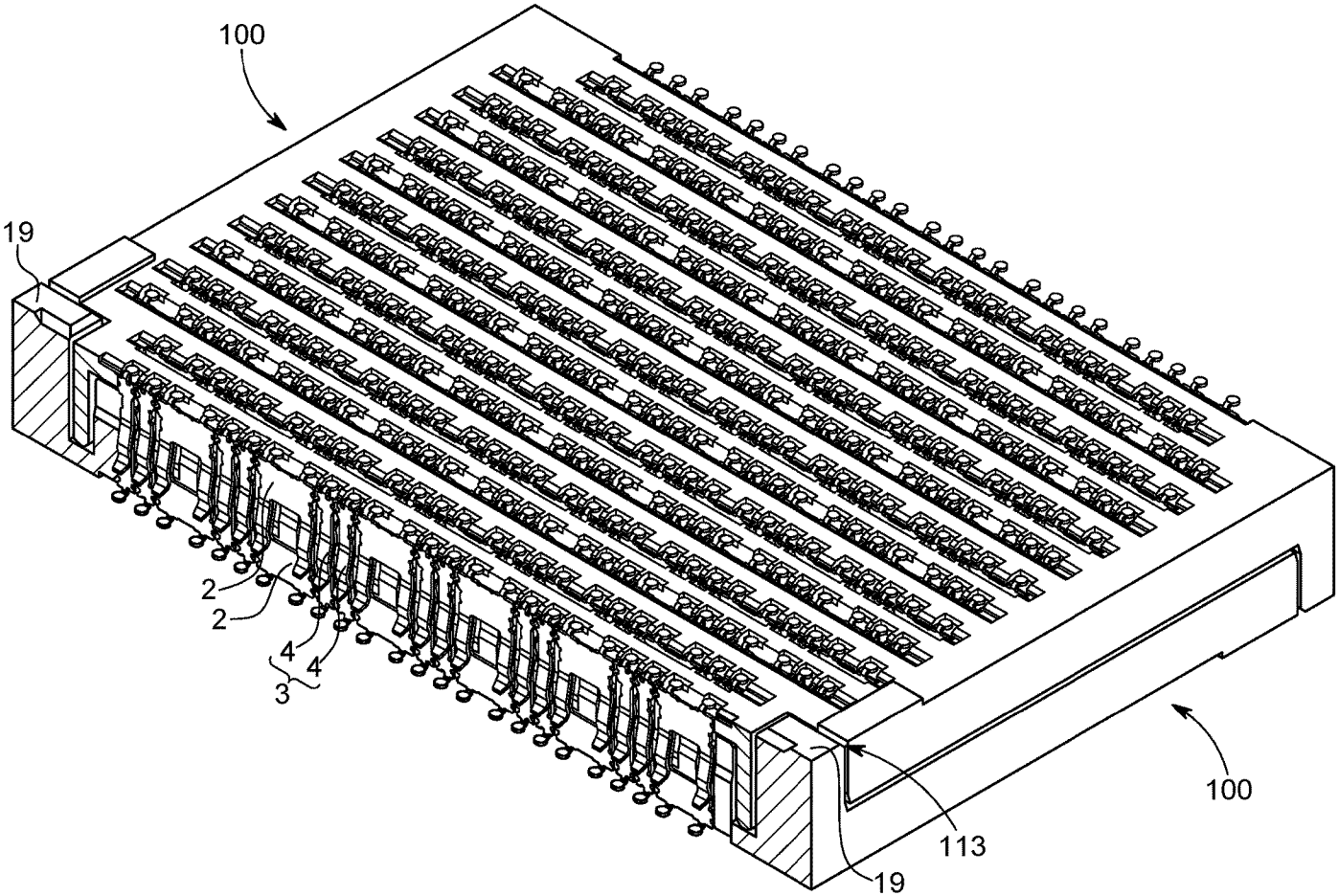
FIG. 15 is a perspective sectional view illustrating that the two electrical connectors of the first embodiment are in an assembled state.

Referring to FIG. 2, FIG. 4 and FIG. 15, the insulating housing 1 of each electrical connector 100 further has two positioning grooves 113 which are adjacent to the first side 111 and are positioned at two opposite ends in the first direction D1, a side wall 13 which protrudes from the bottom wall 11, is adjacent to the second side 112, extends along the first direction D1 and exhibits as an elongated shape, and two positioning keys 19 which protrude from the bottom wall 11 and respectively extend from two ends of the side wall 13 in form of L shape. The two positioning keys 19 of one electrical connector 100 are respectively latched with the two positioning grooves 113 of the other electrical connector 100. In the embodiment, the two electrical connectors 100 are mezzanine-style electrical connectors, with the above structural design, it may prevent the two electrical connectors 100 from improperly mating with each other and can make the mated terminals properly aligned.

Figure 16:
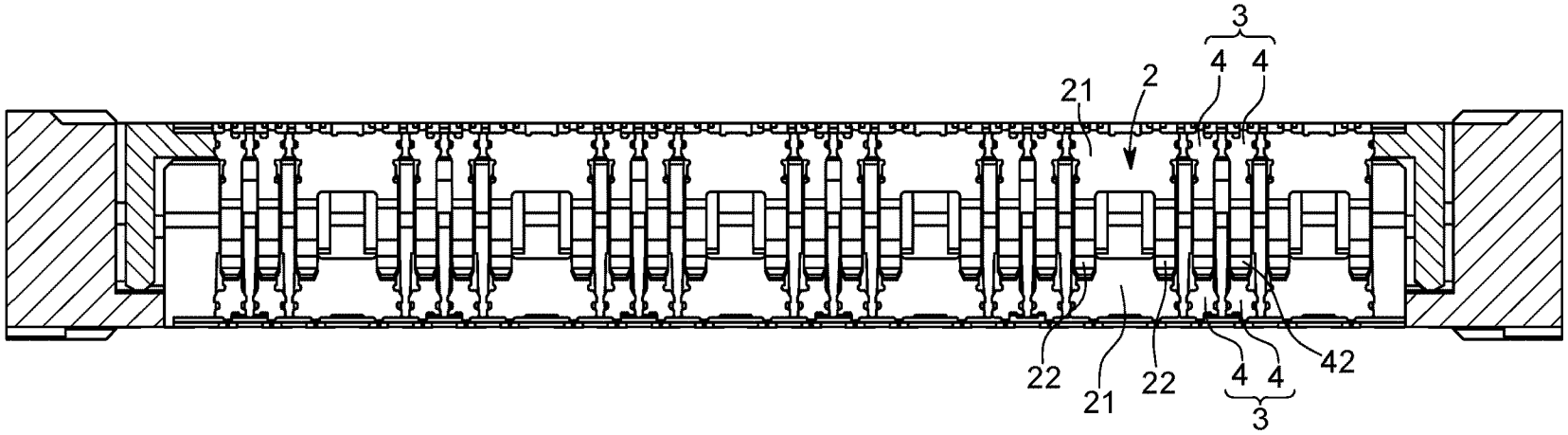
FIG. 16 is a cross sectional view illustrating that the two electrical connectors of the first embodiment are in the assembled state.

Referring to FIG. 16 to FIG. 18, when the two electrical connectors 100 are mated with each other, the protruding bar 14 of one electrical connector 100 correspondingly inserts into the insertion slot 15 of the other electrical connector 100, so corresponding ground terminals 2 of the two electrical connectors 100 can be mated with each other and corresponding signal terminals 4 of the two electrical connectors 100 can be mated with each other. Also, mated ground terminals 2 make every two elastic contact portions 22 mated with each other and every two mated elastic contact portions 22 form two contact points, two groups of mated elastic contact portions 22 totally form four contact points. Mated signal terminals 4 make the two elastic contact portions 42 mated with each other and form two contact points. Specifically, in the embodiment, each elastic contact portion 22 of one ground terminal 2 of the two mated ground terminals 2 contact one body portion 21 of the other ground terminal 2 of the two mated ground terminals 2 to form a contact point, and the body portion 21 of the ground terminal 2 abuts against the groove wall defining the ground terminal receiving groove 16 (see FIG. 8) and thus can provide a stable and reliable contact normal force for the elastic contact portion 22, and there are totally four contact points between two mated ground terminals 2, which assures that the mated ground terminals 2 maintain stable electrical connection. Similarly, in the embodiment, each elastic contact portion 42 of one signal terminal 4 of the two mated signal terminals 4 contacts the body portion 41 of the other signal terminal 4 of the two mated signal terminals 4 to form a contact point, and the body portion 41 of the signal terminal 4 abuts against the groove wall defining the signal terminal receiving groove 17 (see FIG. 8) and thus can provide a stable and reliable contact normal force for the elastic contact portion 42, and there are totally two contact points between the two mated signal terminals 4, which assures the mate signal terminals 4 can maintain stable electrical connection.

Figure 19:
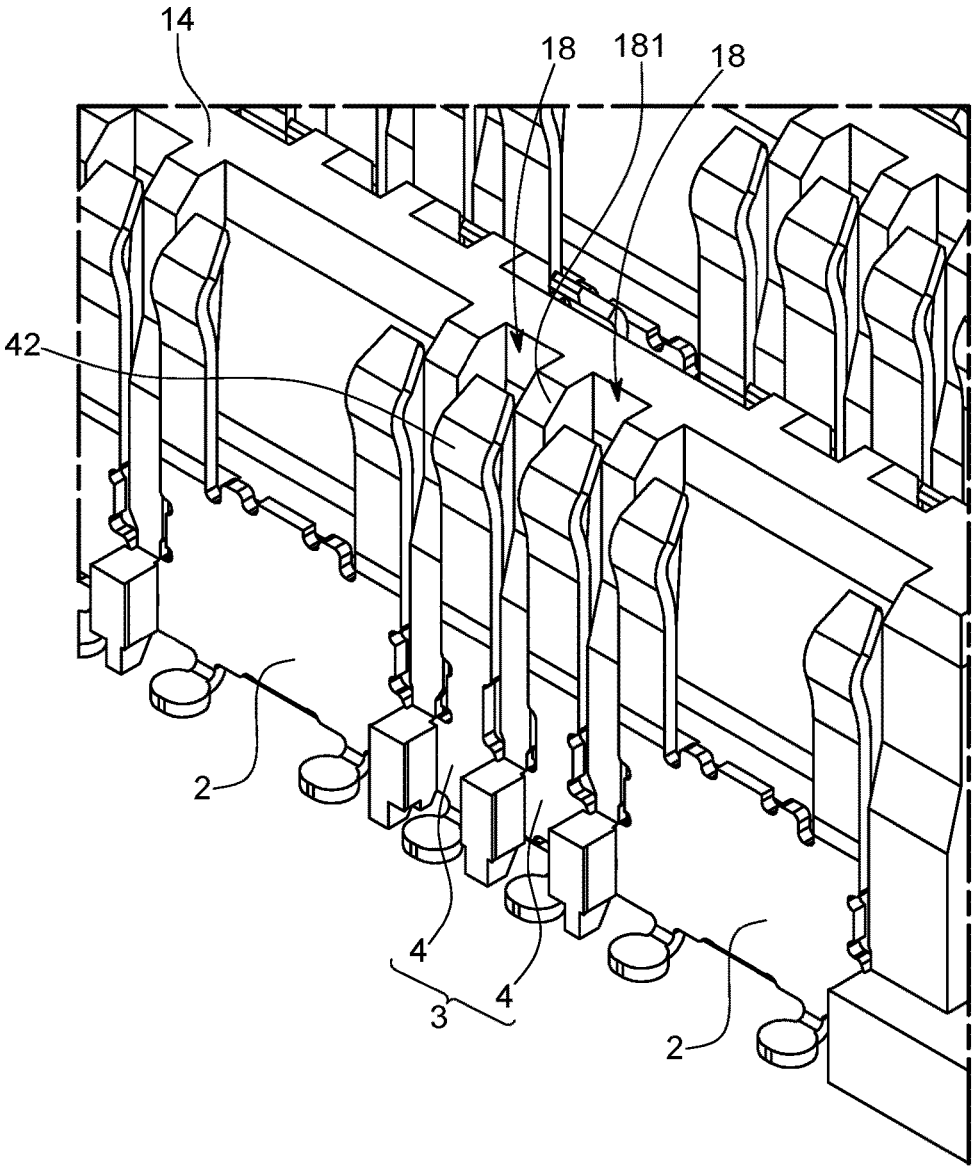
FIG. 19 is a non-complete perspective sectional view of a second embodiment of the electrical connector assembly of the present disclosure.
Figure 20:
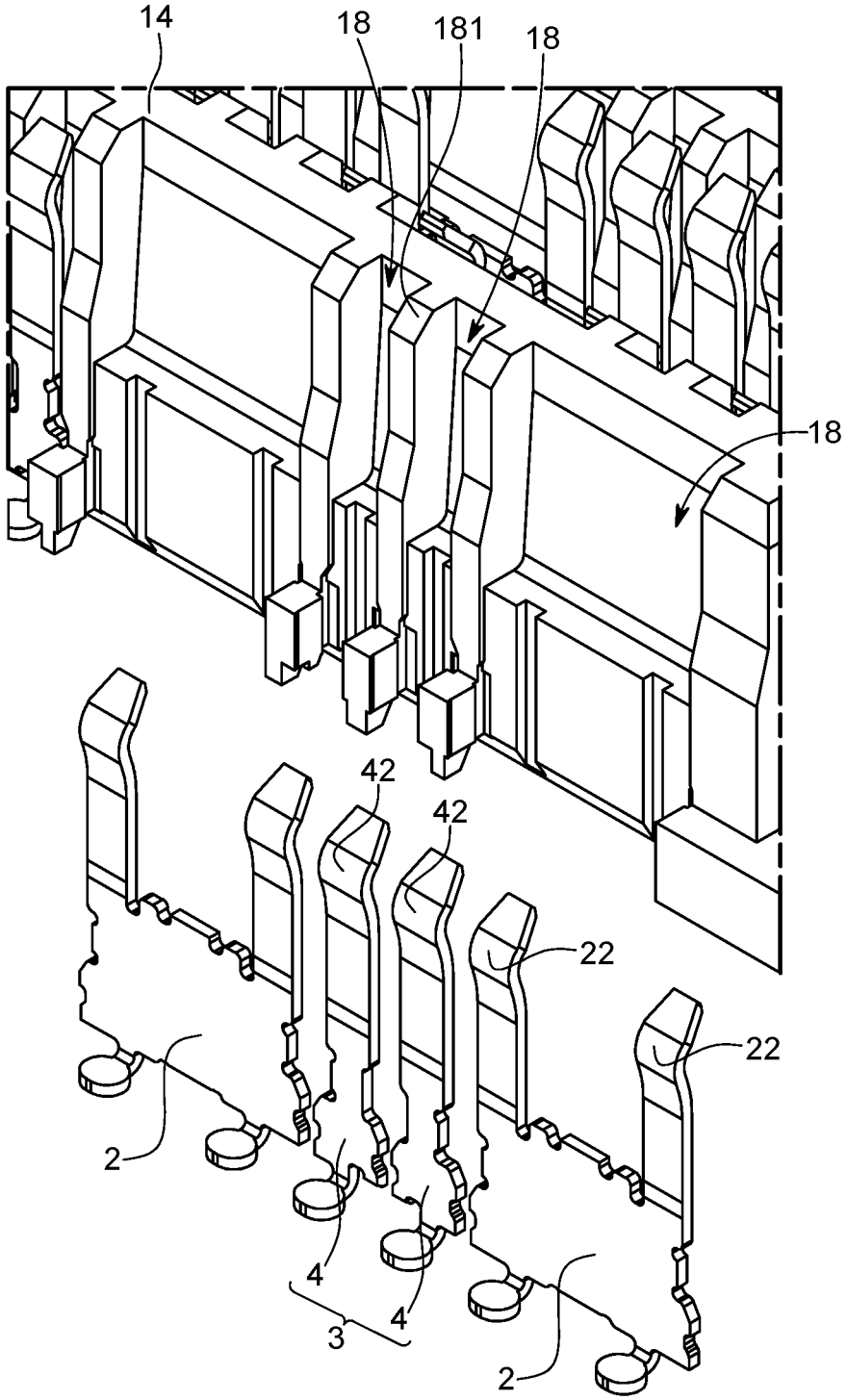
FIG. 20 is a perspective exploded view similar to FIG. 19.
Figure 21:
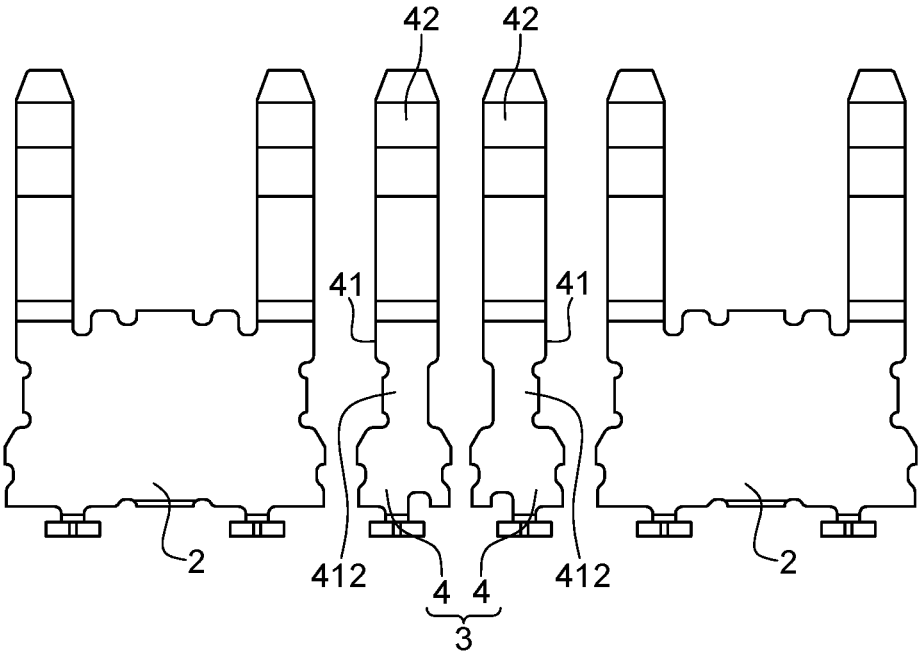
FIG. 21 is a front view of terminals of FIG. 20.
Figure 22:
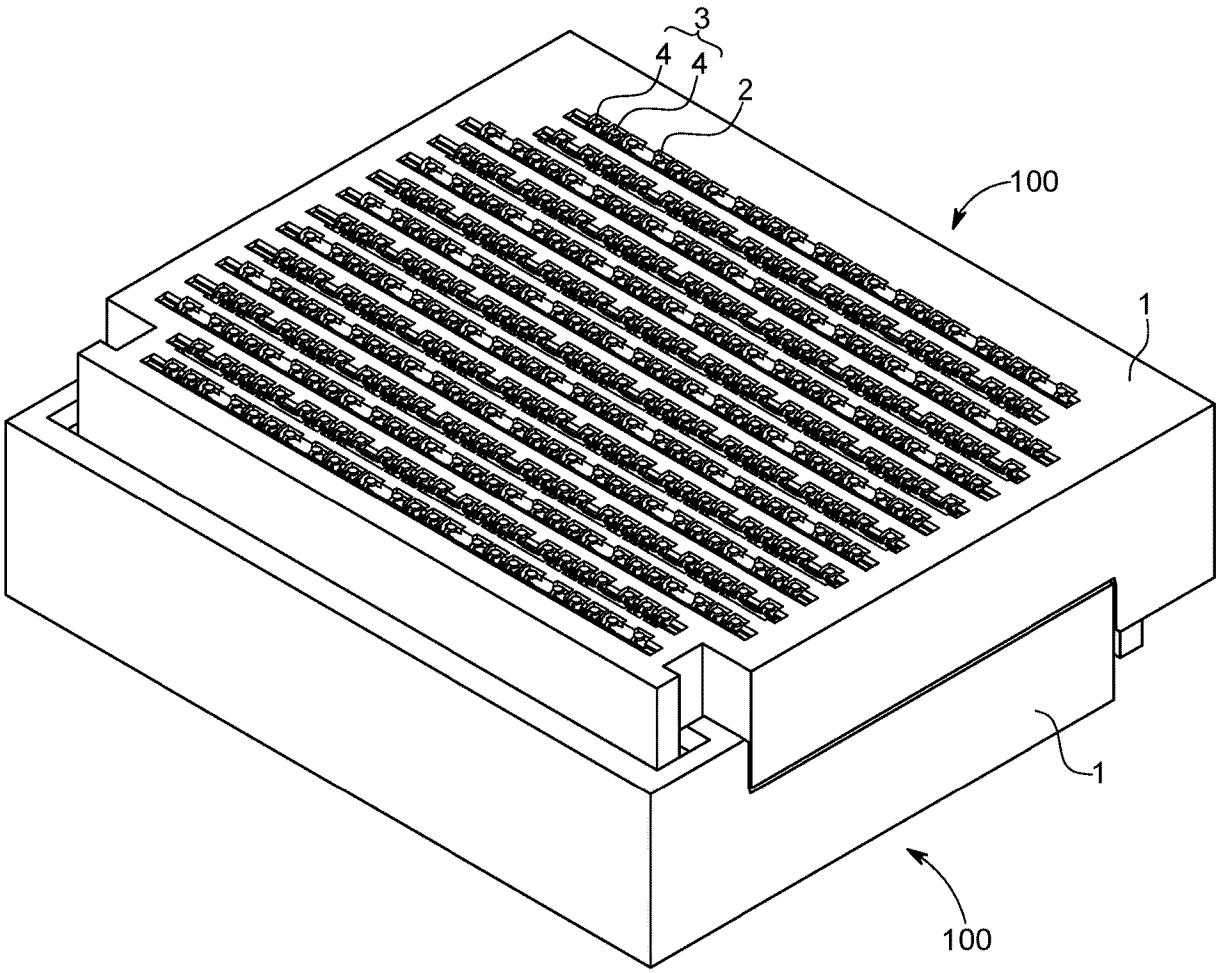
FIG. 22 is a perspective view of a third embodiment of the electrical connector assembly of the present disclosure in an assembled state.
Figure 23:
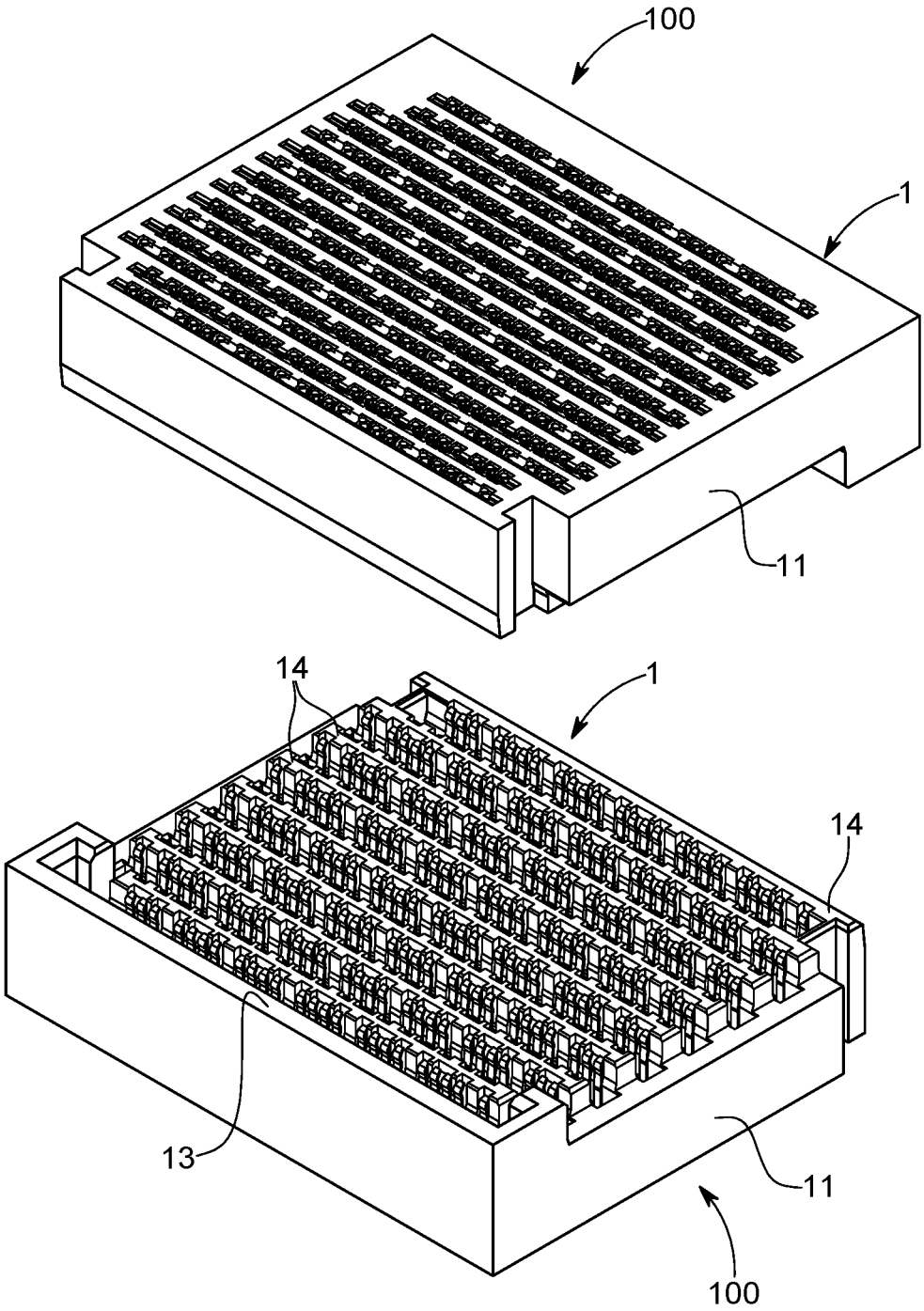
FIG. 23 is a perspective exploded view of the third embodiment.
Figure 24:
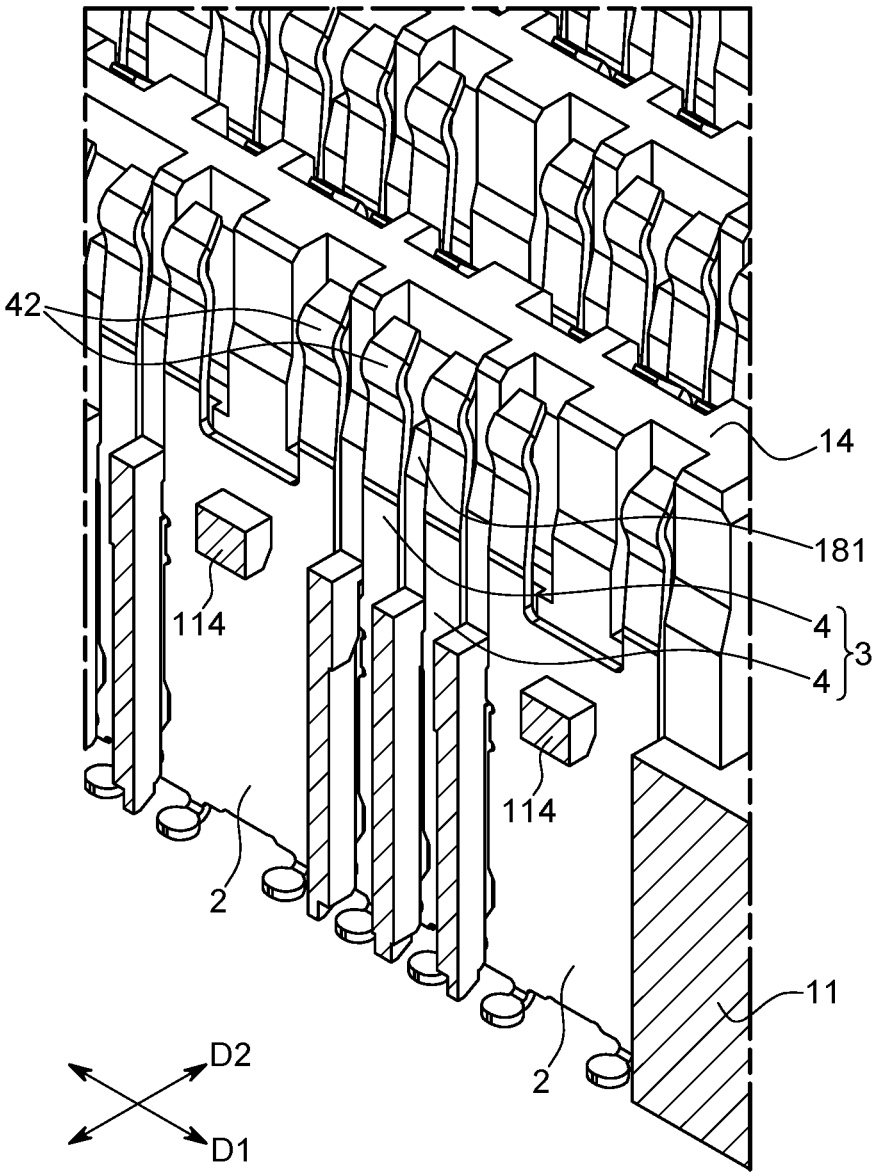
FIG. 24 is a non-complete perspective sectional view of one of two electrical connectors of the third embodiment.
Figure 25:
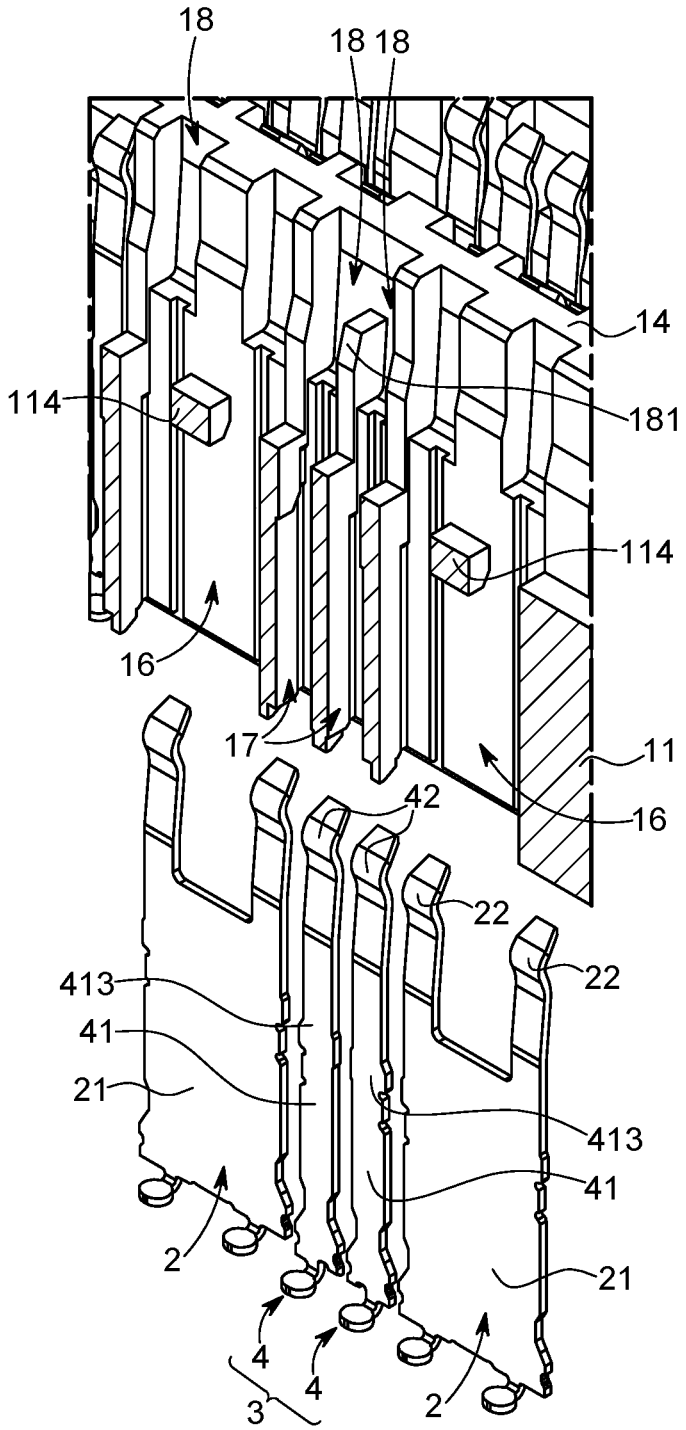
FIG. 25 is a perspective exploded view similar to FIG. 24.

Referring to FIG. 19 to FIG. 21, a second embodiment of the electrical connector assembly of the present disclosure is substantively the same as the first embodiment. However in the second embodiment, the necked-down segment 412 of each signal terminal 4 is formed by recessing inwardly two sides of the body portion 41 toward each other. Moreover, in the second embodiment, that the two recessed accommodating portions 18 corresponding to each differential signal terminal pair 3 are not communicated may be also implemented, that is, there is a complete spacing rib 181 between the two recessed accommodating portions 18. However, that the two recessed accommodating portions 18 are partially communicated in the first embodiment is preferable. In addition, the recessed accommodating portion 18 corresponding to the same ground terminal 2 also may be a wider region so as to correspond to the two elastic contact portions 22 of the ground terminal 2 at the same time.

Referring to FIG. 22 to FIG. 25, a third embodiment of the electrical connector assembly of the present disclosure is substantively the same as the first embodiment. However a height of each electrical connector 100 in the third embodiment is higher, that is, a height of the insulating housing 1 in the third embodiment is higher than a height of the insulating housing 1 in the first embodiment, and a length of the ground terminal 2 and is larger than a length of the ground terminal 2 and a length of the signal terminal 4 in the third embodiment is larger than a length of the signal terminal 4 in the first embodiment. Moreover, in the third embodiment, the bottom wall 11 of the insulating housing 1 is thicker, the ground terminal receiving groove 16 and the signal terminal receiving groove 17 respectively pass through the bottom wall 11 and extend to the protruding bar 14, and an abutting block 114 protrudes from a wall surface of the bottom wall 11 which faces the corresponding protruding bar 14 at a region of the wall surface which corresponds to each ground terminal receiving groove 16, to abut against a region of the body portion 21 of the ground terminal 2 close to the elastic contact portions 22, so as to make positioning of the ground terminal 2 in the ground terminal receiving groove 16 more firmly and the ground terminal 2 will not move in the second direction D2.

Figure 26:
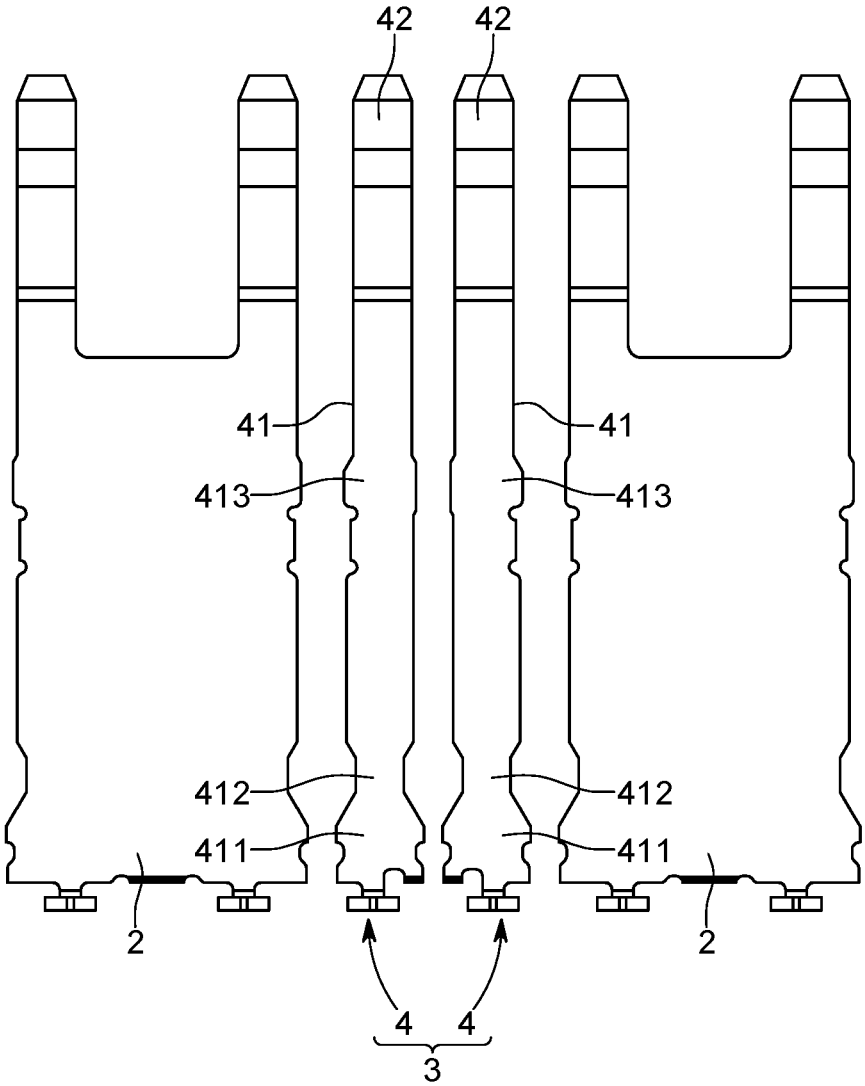
FIG. 26 is a front view of terminals of FIG. 25.
Figure 27:
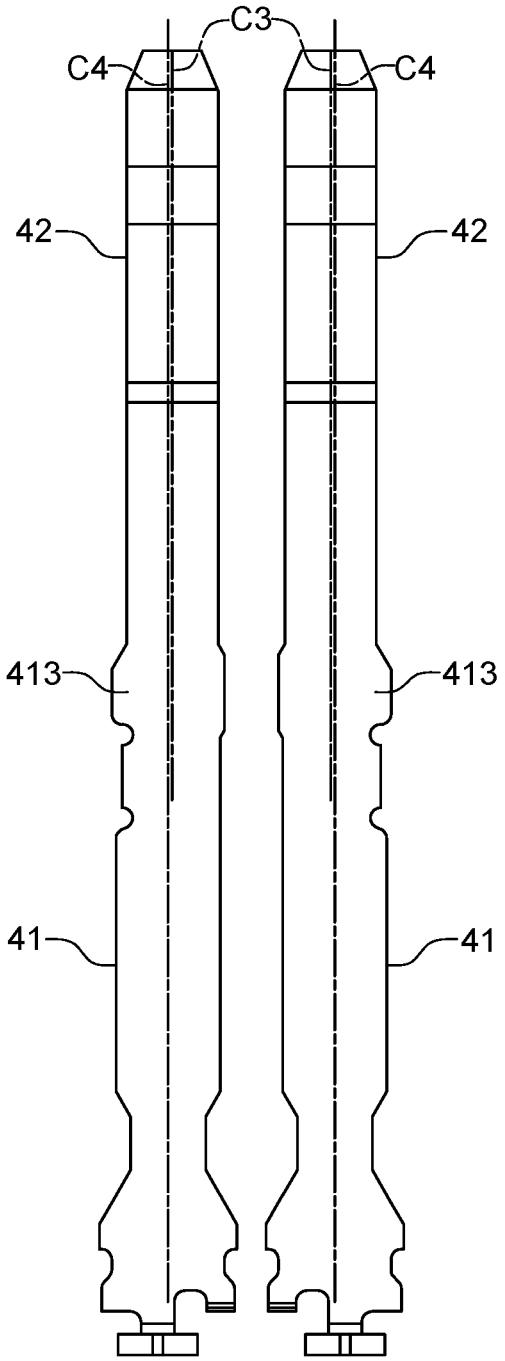
FIG. 27 is an enlarged view of a differential signal terminal pair of FIG. 26.
Figure 28:
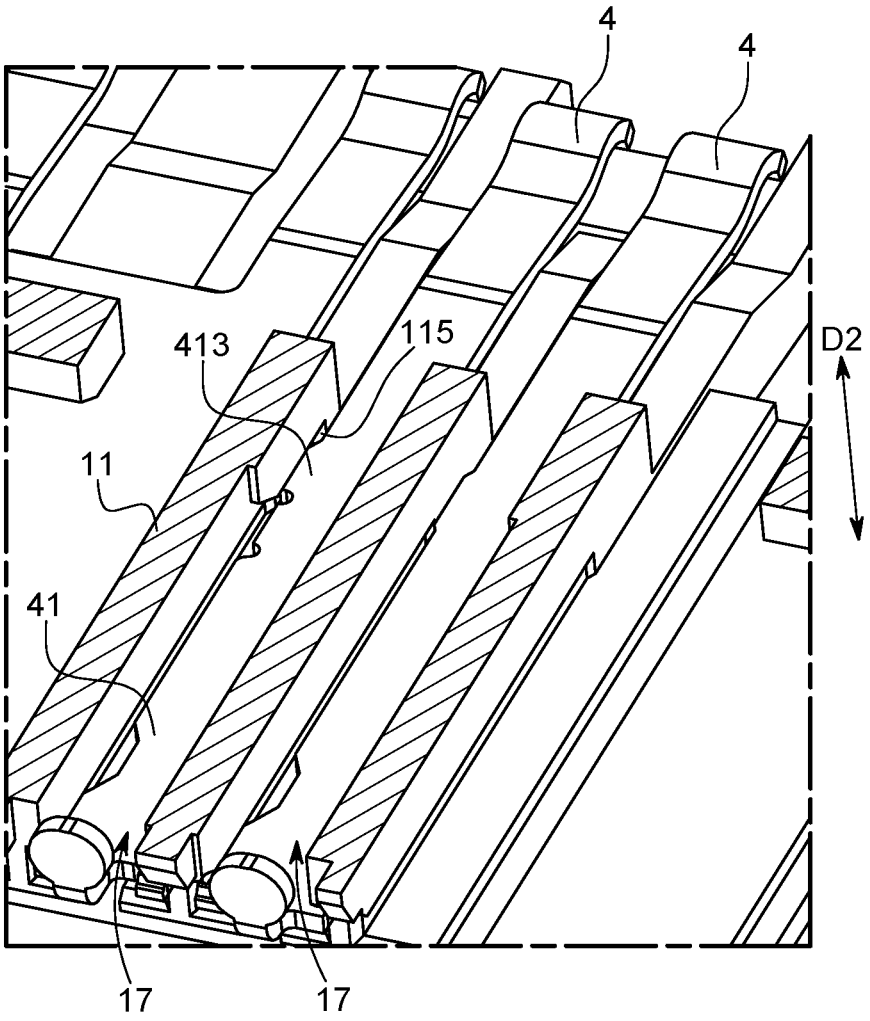
FIG. 28 is a view of FIG. 24 viewed from another angle.

Referring to FIG. 26 to FIG. 28, in the third embodiment, the body portion 41 of each signal terminal 4 of each differential signal terminal pair 3 further has a stopping block 413 close to the elastic contact portion 42 and protruding from the outer opposite side. Also, the insulating housing 1 is formed with a narrow groove portion 115 in form of slit at a region of the insulating housing 1 corresponding to each signal terminal receiving groove 17 to latch with the stopping block 413, which makes the body portion 41 not move in the second direction D2 so as to make positioning of the signal terminal 4 in the signal terminal receiving groove 17 more firmly. Moreover, in the third embodiment, a central line C3 of the elastic contact portion 42 of each signal terminal 4 of each differential signal terminal pair 3 is offset relative to a central line C4 of the body portion 41 toward the inner facing side.

Again referring to FIG. 24 to FIG. 27, in the third embodiment, similar to the first embodiment, a height of the spacing rib 181 between the two recessed accommodating portions 18 corresponding to the two elastic contact portions 42 of each differential signal terminal pair 3 is lower than a height of the elastic contact portion 42, so that two parts of the two elastic contact portions 42 of each differential signal terminal pair 3 respectively approaching the tail ends of the two elastic contact portions 42 are not blocked by the spacing rib 181, and the stopping blocks 413 of the two signal terminals 4 of each differential signal terminal pair 3 are respectively positioned at the two outer opposite sides of the signal terminals 4, at the same time the central line C3 of each elastic contact portion 42 of the two signal terminals 4 is offset relative to the central line C4 of the body portion 41 toward the inner facing side, so that the two signal terminals 4 may be more close to each other, that is, a distance between the two signal terminals 4 is reduced, which can further increase coupling between the two signal terminals of each differential signal terminal pair 3 and enhance signal integrity. Moreover, in the third embodiment, the necked-down segment 412 of each signal terminal 4 is formed by recessing inwardly the two sides of the body portion 41 toward each other, which is similarly used to adjust impedance.

Figure 29:
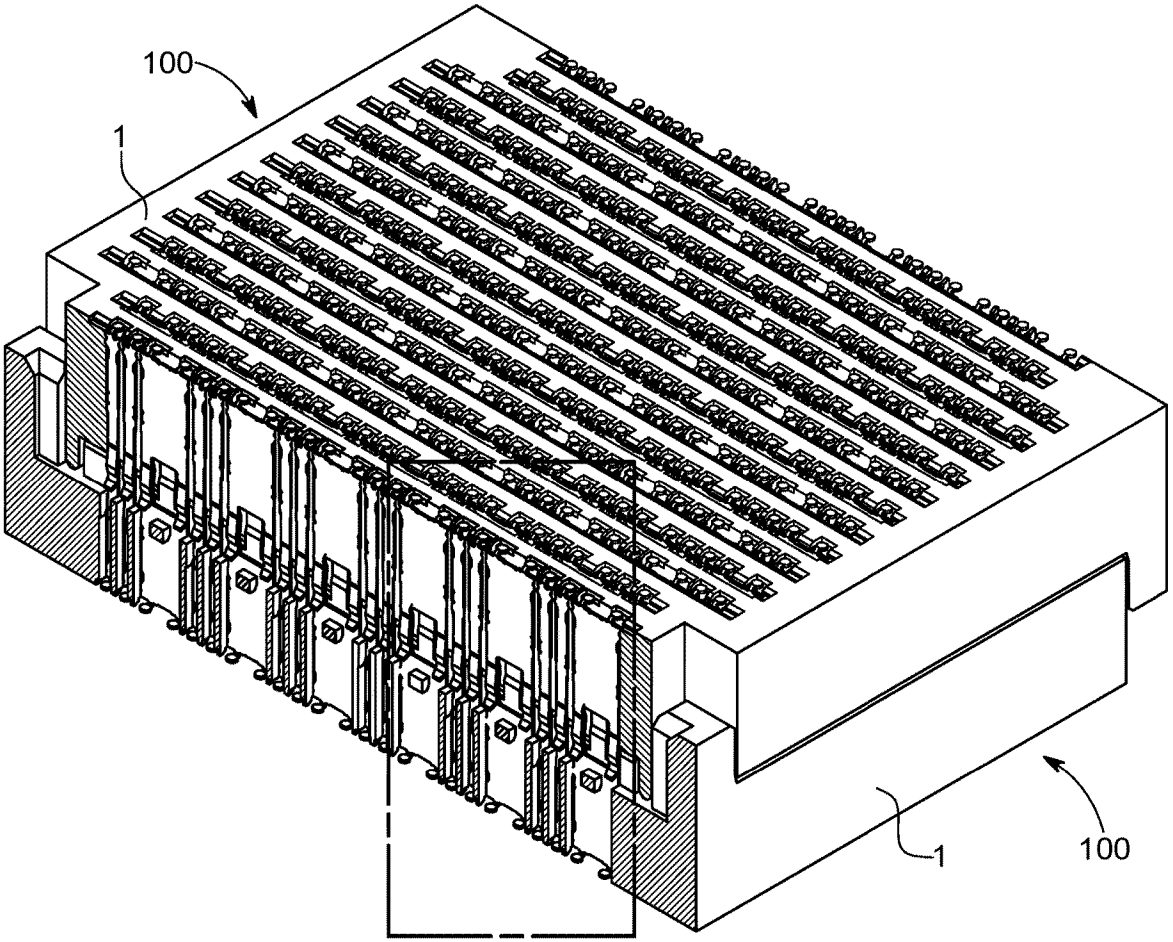
FIG. 29 is a perspective sectional view of the two electrical connectors of the third embodiment in the assembled state.
Figure 30:
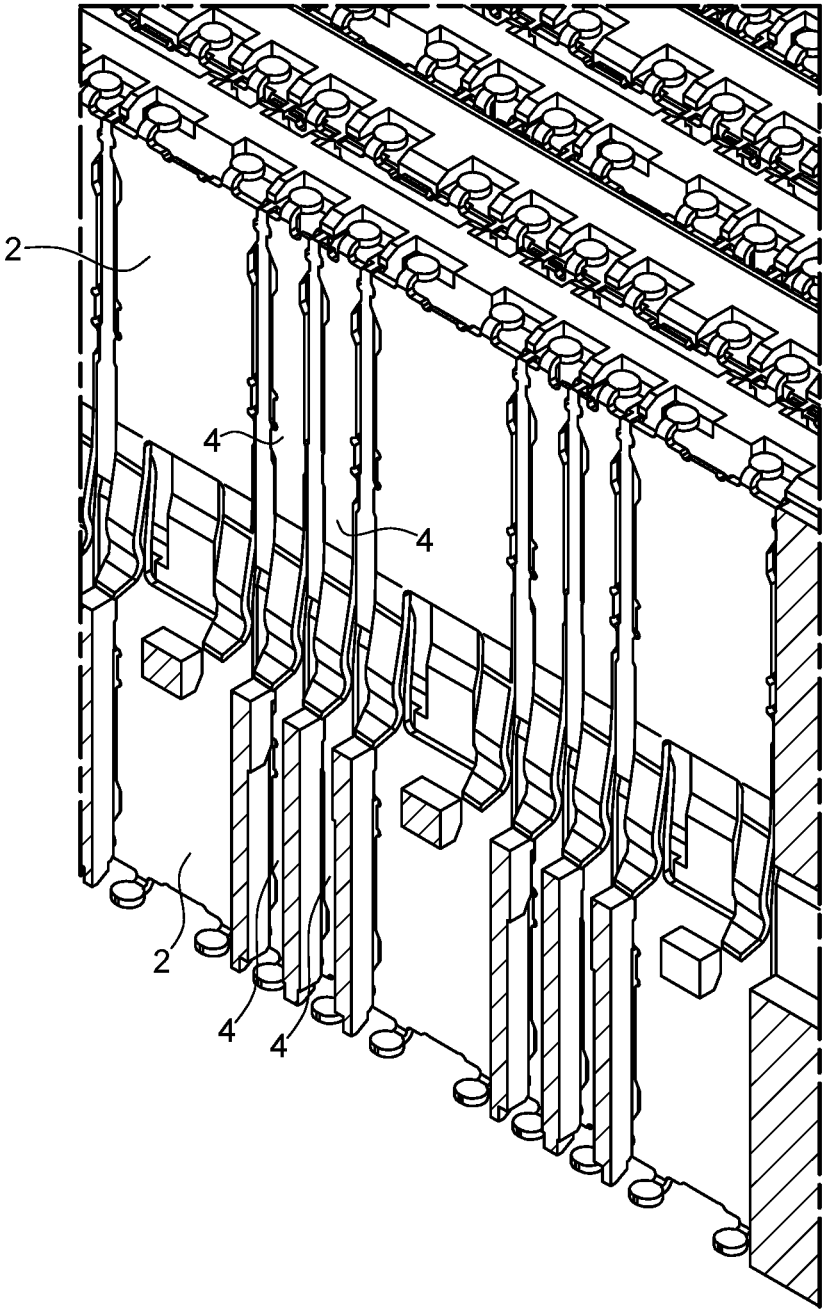
FIG. 30 is a partial enlarged view of FIG. 29.

Referring to FIG. 29 and FIG. 30, in the third embodiment, when the two electrical connectors 100 are mated with each other, a mating relationship of the two insulating housings 1, a mating relationship between the terminals 2 and a mating relationship between the terminals 4 are the same as the first embodiment, therefore detailed description is omitted herein.

However, the above description only relates to the embodiments of the present disclosure which is not intended to limit the scope of implementing the present disclosure, any simple equivalent variations and modifications according to the scope of the present disclosure and the contents of the present specification belong to the scope of the present disclosure.

What is claimed is:

1. An electrical connector, comprising:

an insulating housing; and a plurality of terminal columns arranged at least partially within the insulating housing, each terminal column comprising a plurality of ground terminals and a plurality of differential signal terminal pairs arranged along a first direction, the ground terminals and the differential signal terminal pairs being alternately arranged in each terminal column, and the terminal columns being arranged along a second direction perpendicular to the first direction and being spaced apart from each other;

each ground terminal having a body portion and two elastic contact portions extending from the body portion and spaced apart from each other, each differential signal terminal pair being composed of two signal terminals, adjacent sides of the two signal terminals of each differential signal terminal pair arranged side by side each being defined as an inner facing side of each signal terminal and a side of each signal terminal opposite to the inner facing side being defined as an outer opposite side, and each signal terminal having a body portion and an elastic contact portion extending from the body portion, and a total width of the two body portions of each differential signal terminal pair in the first direction being smaller than a width of the body portion of each ground terminal in the first direction, an orthogonal projection of the two body portions of a differential signal terminal pair onto an adjacent terminal column in the second direction being positioned within a range covered by the width of the body portion of one corresponding ground terminal of the adjacent terminal column; a total width of the two elastic contact portions of each differential signal terminal pair in the first direction being smaller than a total width of the two elastic contact portions of each ground terminal in the first direction, an orthogonal projection of the two elastic contact portions of a differential signal terminal pair onto the adjacent terminal column in the second direction being positioned within a range which is covered by the total width of the two elastic contact portions of one corresponding ground terminal of the adjacent terminal column.

2. The electrical connector as claim 1, wherein each ground terminal further has two tail portions extending from the body portion of each ground terminal and spaced apart from each other, and the two tail portions and the two elastic contact portions of each ground terminal respectively extend from two opposite sides of the body portion of each ground terminal, each signal terminal of each differential signal terminal pair further has a tail portion extending from the body portion of each signal terminal, and the tail portion and the elastic contact portion of each signal terminal respectively extend from two opposite sides of the body portion of each signal terminal, a total width of the two tail portions of each differential signal terminal pair in the first direction is smaller than a total width of the two tail portions of each ground terminal in the first direction, an orthogonal projection of the two tail portions of each differential signal terminal pair on the adjacent terminal column along the second direction is positioned within a range which is covered by the total width of the two tail portions of one corresponding ground terminal of the adjacent terminal column.

3. The electrical connector as claim 2, wherein a central line of the elastic contact portion of each signal terminal of each differential signal terminal pair is offset relative to a central line of the body portion of each signal terminal of each differential signal terminal pair toward the inner facing side of that signal terminal.

4. The electrical connector as claims 2, wherein an orthogonal projection of the body portion of the ground terminal of each terminal column along the second direction and an orthogonal projection of the body portion of the ground terminal of the adjacent terminal column along the second direction are partially overlapped.

5. The electrical connector as claims 2, wherein the body portion of each signal terminal of each differential signal terminal pair has a retention segment which is close to the tail portion of each signal terminal and two sides of which are formed with a plurality of retention protrusions interfering with the insulating housing and a necked-down segment which is adjacent to the retention segment and is reduced in width relative to the retention segment.

6. The electrical connector as claims 1, wherein the insulating housing has a bottom wall, the bottom wall has a first side and a second side which are parallel to the first direction and are positioned at two opposite ends, the insulating housing further has a plurality of protruding bars which are parallel to each other, are spaced apart from each other, protrude from the bottom wall, are positioned between the first side and the second side, extend along the first direction and each exhibit as an elongated shape, the bottom wall and the protruding bars together define a plurality of insertion slots, and the protruding bars and the insertion slots are alternately arranged along the second direction, the insulating housing further has a plurality of ground terminal receiving grooves respectively receiving the ground terminals and a plurality of signal terminal receiving grooves respectively receiving the signal terminals, the ground terminal receiving grooves and the signal terminal receiving grooves are provided to wall surfaces of the protruding bars adjacent to the insertion slots.

7. The electrical connector as claim 6, wherein the insulating housing further has a plurality of recessed accommodating portions respectively corresponding to the elastic contact portions in position, and every two recessed accommodating portions corresponding to each differential signal terminal pair are communicated with each other at two portions which each correspondingly approach a tail end of the elastic contact portion of each signal terminal.

8. The electrical connector as claim 6, wherein the body portion of each signal terminal of each differential signal terminal pair has a stopping block close to the elastic contact portion of each signal terminal and protruding from the outer opposite side of each signal terminal, the insulating housing is formed with a narrow groove portion in form of slit at a region of the insulating housing corresponding to each signal terminal receiving groove to latch with the stopping block, which makes the body portion of each signal terminal not move in the second direction.

9. The electrical connector as claim 6, wherein the insulating housing further has two positioning grooves which are adjacent to the first side and are positioned at two opposite ends in the first direction, a side wall which protrudes from the bottom wall, is adjacent to the second side, extends along the first direction and exhibits as an elongated shape, and two positioning keys which protrude from the bottom wall and respectively extend from two ends of the side wall in form of L shape, the two positioning keys are respectively latched with the two positioning grooves of another electrical connector which has the same structure.

10. An electrical connector assembly, comprising two electrical connectors which have the same structure and are mated with each other, each electrical connector comprising:

an insulating housing; and a plurality of terminal columns arranged at least partially within the insulating housing, each terminal column comprising a plurality of ground terminals and a plurality of differential signal terminal pairs arranged along a first direction, the ground terminals and the differential signal terminal pairs being alternately arranged in each terminal column, and the terminal columns being arranged along a second direction perpendicular to the first direction and being spaced apart from each other;

each ground terminal having a body portion and two elastic contact portions extending from the body portion and spaced apart from each other, each differential signal terminal pair being composed of two signal terminals, adjacent sides of the two signal terminals of each differential signal terminal pair arranged side by side each being defined as an inner facing side of each signal terminal and a side of each signal terminal opposite to the inner facing side being defined as an outer opposite side, and each signal terminal having a body portion and an elastic contact portion extending from the body portion, and a total width of the two body portions of each differential signal terminal pair in the first direction being smaller than a width of the body portion of each ground terminal in the first direction, an orthogonal projection of the two body portions of a differential signal terminal pair onto an adjacent terminal column in the second direction being positioned within a range covered by the width of the body portion of one corresponding ground terminal of the adjacent terminal column; a total width of the two elastic contact portions of each differential signal terminal pair in the first direction being smaller than a total width of the two elastic contact portions of each ground terminal in the first direction, an orthogonal projection of the two elastic contact portions of a differential signal terminal pair onto the adjacent terminal column in the second direction being positioned within a range which is covered by the total width of the two elastic contact portions of one corresponding ground terminal of the adjacent terminal column.

11. The electrical connector assembly as claim 10, wherein when the two electrical connectors are mated with each other, mated ground terminals make every two elastic contact portions of the mated ground terminals mated with each other and every two mated elastic contact portions form two contact points, mated signal terminals make the two elastic contact portions of the mated signal terminals mated with each other and form two contact points.

12. The electrical connector assembly as claim 11, wherein each ground terminal of each electrical connector further has two tail portions extending from the body portion of each ground terminal and spaced apart from each other, and the two tail portions and the two elastic contact portions of each ground terminal respectively extend from two opposite sides of the body portion of each ground terminal, each signal terminal of each differential signal terminal pair further has a tail portion extending from the body portion of each signal terminal, and the tail portion and the elastic contact portion of each signal terminal respectively extend from two opposite sides of the body portion of each signal terminal, a total width of the two tail portions of each differential signal terminal pair in the first direction is smaller than a total width of the two tail portions of each ground terminal in the first direction, an orthogonal projection of the two tail portions of each differential signal terminal pair on the adjacent terminal column along the second direction is positioned within a range which is covered by the total width of the two tail portions of one corresponding ground terminal of the adjacent terminal column.

13. The electrical connector assembly as claim 12, wherein a central line of the elastic contact portion of each signal terminal of each differential signal terminal pair is offset relative to a central line of the body portion of each signal terminal of each differential signal terminal pair toward the inner facing side of that signal terminal.

14. The electrical connector assembly as claims 12, wherein the body portion of each signal terminal of each differential signal terminal pair of each electrical connector has a retention segment which is close to the tail portion of each signal terminal and two sides of which are formed with a plurality of retention protrusions interfering with the insulating housing and a necked-down segment which is adjacent to the retention segment and is reduced in width relative to the retention segment.

15. The electrical connector assembly as claim 10, wherein the insulating housing of each electrical connector has a bottom wall, the bottom wall has a first side and a second side which are parallel to the first direction and are positioned at two opposite ends, the insulating housing further has a plurality of protruding bars which are parallel to each other, are spaced apart from each other, protrude from the bottom wall, are positioned between the first side and the second side, extend along the first direction and each exhibit as an elongated shape, the bottom wall and the protruding bars together define a plurality of insertion slots, and the protruding bars and the insertion slots are alternately arranged along the second direction, the insulating housing further has a plurality of ground terminal receiving grooves respectively receiving the ground terminals and a plurality of signal terminal receiving grooves respectively receiving the signal terminals, the ground terminal receiving grooves and the signal terminal receiving grooves are provided to wall surfaces of the protruding bars adjacent to the insertion slots.

16. The electrical connector assembly as claim 15, wherein the insulating housing of each electrical connector further has a plurality of recessed accommodating portions respectively corresponding to the elastic contact portions in position, and every two recessed accommodating portions corresponding to each differential signal terminal pair are communicated with each other at two portions which each correspondingly approach a tail end of the elastic contact portion of each signal terminal.

17. The electrical connector assembly as claim 15, wherein the body portion of each signal terminal of each differential signal terminal pair has a stopping block close to the elastic contact portion of each signal terminal and protruding from the outer opposite side of each signal terminal, the insulating housing is formed with a narrow groove portion in form of slit at a region of the insulating housing corresponding to each signal terminal receiving groove to latch with the stopping block, which makes the body portion of each signal terminal not move in the second direction.

18. The electrical connector assembly as claim 15, wherein the insulating housing of each electrical connector further has two positioning grooves which are adjacent to the first side and are positioned at two opposite ends in the first direction, a side wall which protrudes from the bottom wall, is adjacent to the second side, extends along the first direction and exhibits as an elongated shape, and two positioning keys which protrude from the bottom wall and respectively extend from two ends of the side wall in form of L shape, the two positioning keys are used to respectively latch with the two positioning grooves of the other electrical connector.

19. The electrical connector assembly as claim 10, wherein the two the electrical connector are mezzanine electrical connectors.

20. An electrical connector, comprising:

an insulating housing; and a plurality of terminal columns arranged at least partially within the insulating housing, each terminal column comprising a plurality of ground terminals and a plurality of differential signal terminal pairs arranged along a first direction, and the ground terminals and the differential signal terminal pairs being alternately arranged in each terminal column, each ground terminal having two tail portions spaced apart from each other, each signal terminal of each differential signal terminal pair having a tail portion, and a total width of the two tail portions of each differential signal terminal pair in the first direction being smaller than a total width of the two tail portions of each ground terminal in the first direction, the terminal columns being arranged along a second direction perpendicular to the first direction and being spaced apart from each other, an arrangement pattern of the terminals of the terminal columns being: the terminals of one terminal column of two adjacent terminal columns being alternately arranged as one ground terminal, one differential signal terminal pair and one ground terminal so as to make two tail portions of one ground terminal, two tail portions of two signal terminals, two tail portions of one ground terminal alternately arranged along the first direction, the terminals of the other terminal column of the two adjacent terminal columns being alternately arranged as one differential signal terminal pair, one ground terminal and one differential signal terminal pair so as to make two tail portions of two signal terminals, two tail portions of one ground terminal, two tail portions of two signal terminals alternately arranged along the first direction, and the differential signal terminal pair of the one terminal column of the two adjacent terminal columns corresponding to the ground terminal of the other terminal column of the two adjacent terminal columns in position in the second direction, an orthogonal projection of the two tail portions of a differential signal terminal pair of the one terminal column of the two adjacent terminal columns in the second direction being positioned within a range which is covered by the total width of the two tail portions of one corresponding ground terminal of the other terminal column of the two adjacent terminal columns.

* * * * *